US008824951B2

(12) United States Patent
Ooyoshi et al.

(10) Patent No.: US 8,824,951 B2
(45) Date of Patent: Sep. 2, 2014

(54) TONER CONVEYOR, PROCESS CARTRIDGE, AND IMAGE FORMING APPARATUS

(71) Applicants: Hirobumi Ooyoshi, Kanagawa (JP); Yuusuke Furuichi, Osaka (JP)

(72) Inventors: Hirobumi Ooyoshi, Kanagawa (JP); Yuusuke Furuichi, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 61 days.

(21) Appl. No.: 13/677,585

(22) Filed: Nov. 15, 2012

(65) Prior Publication Data

US 2013/0136516 A1 May 30, 2013

(30) Foreign Application Priority Data

Nov. 30, 2011 (JP) ..... 2011-262103
Nov. 30, 2011 (JP) ..... 2011-262850

(51) Int. Cl.

| | |
|---|---|
| ***G03G 21/00*** | (2006.01) |
| ***G03G 21/10*** | (2006.01) |
| ***G03G 15/08*** | (2006.01) |
| ***G03G 21/18*** | (2006.01) |

(52) U.S. Cl.

CPC ..... *G03G 15/0865* (2013.01); *G03G 21/105* (2013.01); *G03G 21/18* (2013.01)

USPC ..... 399/358; 399/353; 399/258; 399/350

(58) Field of Classification Search

USPC ..... 399/350, 353, 358, 258

See application file for complete search history.

(56) References Cited

U.S. PATENT DOCUMENTS

| | | | | |
|---|---|---|---|---|
| 6,415,129 | B2 * | 7/2002 | Sawayama | 399/353 |
| 8,320,790 | B2 * | 11/2012 | Yamaguchi | 399/99 |
| 2008/0267661 | A1 | 10/2008 | Yoshida et al. | |
| 2009/0162101 | A1 | 6/2009 | Yoshida et al. | |
| 2009/0285588 | A1 | 11/2009 | Furuichi et al. | |
| 2012/0063806 | A1 | 3/2012 | Kubota et al. | |

FOREIGN PATENT DOCUMENTS

| | | | |
|---|---|---|---|
| CN | 1740925 | A | 3/2006 |
| CN | 101038478 | A | 9/2007 |
| CN | 101086654 | A | 12/2007 |
| JP | 60-031175 | | 2/1985 |
| JP | 63-223773 | | 9/1988 |
| JP | 5-313542 | | 11/1993 |
| JP | 11-143323 | | 5/1999 |
| JP | 2007-271754 | | 10/2007 |

OTHER PUBLICATIONS

Office Action issued Jun. 4, 2014 in Chinese Patent Application No. 2012-10470539.4.

* cited by examiner

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

A toner conveyor includes a noncircular conveyance member rotatable in a predetermined direction of rotation to convey toner to a toner container and a plate-shaped metal scraper slidably contacting the conveyance member with predetermined pressure therebetween to scrape the toner off the conveyance member. The scraper includes a contact end contacting the conveyance member, at least one through-hole spaced apart from the contact end, and a toner carrying face contacting the toner accumulated in the toner container. A lid is attached to the toner carrying face of the scraper to cover the at least one through-hole of the scraper and includes a separation region extending from an upper edge thereof to at least a position disposed opposite a lower edge of the at least one through-hole in a short direction of the scraper. The separation region is separatable from the scraper.

19 Claims, 16 Drawing Sheets

TONER CONVEYOR, PROCESS CARTRIDGE, AND IMAGE FORMING APPARATUS

CROSS-REFERENCE TO RELATED APPLICATIONS

This patent application is based on and claims priority pursuant to 35 U.S.C. §119 to Japanese Patent Application Nos. 2011-262850, filed on Nov. 30, 2011 and 2011-262103, filed on Nov. 30, 2011, in the Japanese Patent Office, the entire disclosure of each of which is hereby incorporated by reference herein.

BACKGROUND OF THE INVENTION

1. Field of the Invention

Exemplary aspects of the present invention relate to a toner conveyor, a process cartridge, and an image forming apparatus, and more particularly, to a toner conveyor for conveying toner, a process cartridge incorporating the toner conveyor, and an image forming apparatus incorporating the process cartridge.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

After the toner image is transferred from the photoconductor, residual toner (hereinafter referred to as waste toner) not transferred onto the intermediate transfer belt or the recording medium may remain on the photoconductor. To address this circumstance, a cleaning blade scrapes the waste toner off the photoconductor onto a toner conveyor that conveys the waste toner to a waste toner container. For example, the toner conveyor includes a polygonal conveyance member that receives the waste toner from the cleaning blade and conveys the waste toner to the waste toner container and a scraper blade that contacts the outer circumferential surface of the conveyance member and scrapes the waste toner off the conveyance member. As the conveyance member rotates in a predetermined direction of rotation, it conveys the waste toner received from the cleaning blade into the waste toner container. Simultaneously, the scraper blade slides over the outer circumferential surface of the rotating conveyance member, thus scraping the waste toner off the conveyance member.

Typically, the scraper blade is made of an elastic polyester film that is elastically deformed or bent to maintain contact with the outer circumferential surface of the polygonal conveyance member at a constant, predetermined pressure. However, since the elastic polyester film is subject to creep strain after the scraper blade is stored at high temperatures indefinitely, it may contact the conveyance member with decreased pressure, thereby degrading its scraping performance.

To address this problem, the scraper blade may be made of metal, which is more resistant to creep strain than elastic polyester film. However, the metal scraper blade, as it is bent to press against the outer circumferential surface of the conveyance member, may contact the conveyance member with increased pressure therebetween, thus increasing torque of a driver that drives and rotates the conveyance member and generating noise as the scraper blade slides over the conveyance member. Moreover, the rigid, metal scraper blade may shave the conveyance member as it slides over the conveyance member, shortening the life of the conveyance member.

SUMMARY OF THE INVENTION

This specification describes below an improved toner conveyor for conveying toner to a toner container. In one exemplary embodiment of the present invention, the toner conveyor includes a noncircular conveyance member rotatable in a predetermined direction of rotation to convey the toner to the toner container and a plate-shaped metal scraper slidably contacting the conveyance member with predetermined pressure therebetween to scrape the toner off the conveyance member. The scraper includes a contact end contacting the conveyance member, at least one through-hole spaced apart from the contact end, and a toner carrying face contacting the toner accumulated in the toner container. A lid is attached to the toner carrying face of the scraper to cover the at least one through-hole of the scraper and includes a separation region extending from an upper edge thereof to at least a position disposed opposite a lower edge of the at least one through-hole in a short direction of the scraper. The separation region is separatable from the scraper.

This specification further describes an improved process cartridge detachably attached to an image forming apparatus. In one exemplary embodiment of the present invention, the process cartridge includes an image carrier to carry a toner image and the toner conveyor described above.

This specification further describes an improved image forming apparatus. In one exemplary embodiment of the present invention, the image forming apparatus includes the process cartridge described above.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
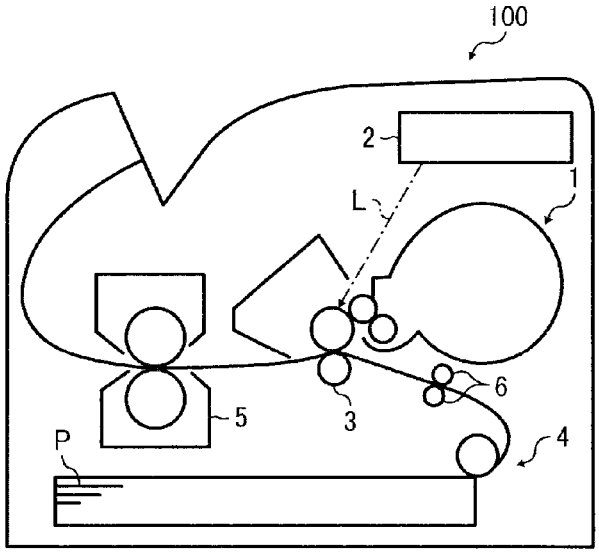
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present invention is explained.

FIG. 1 is a schematic vertical sectional view of the image forming apparatus 100. The image forming apparatus 100 may be a copier, a facsimile machine, a printer, a multifunction printer (MFP) having at least one of copying, printing, scanning, plotter, and facsimile functions, or the like. According to this exemplary embodiment, the image forming apparatus 100 is a laser printer that forms a toner image on a recording medium P by electrophotography.

As shown in FIG. 1, the image forming apparatus 100 includes a process cartridge 1 detachably attached to the image forming apparatus 100; an exposure device 2 situated above the process cartridge 1; a transfer roller 3 disposed opposite the process cartridge 1 and serving as a transferor that transfers a toner image formed by the process cartridge 1 onto a recording medium P; a paper tray 4 situated below the transfer roller 3 and loading recording media P to be supplied to the transfer roller 3; a registration roller pair 6 disposed upstream from the transfer roller 3 in a recording medium conveyance direction; and a fixing device 5 (e.g., a fuser) disposed downstream from the transfer roller 3 in the recording medium conveyance direction.

Figure 2:
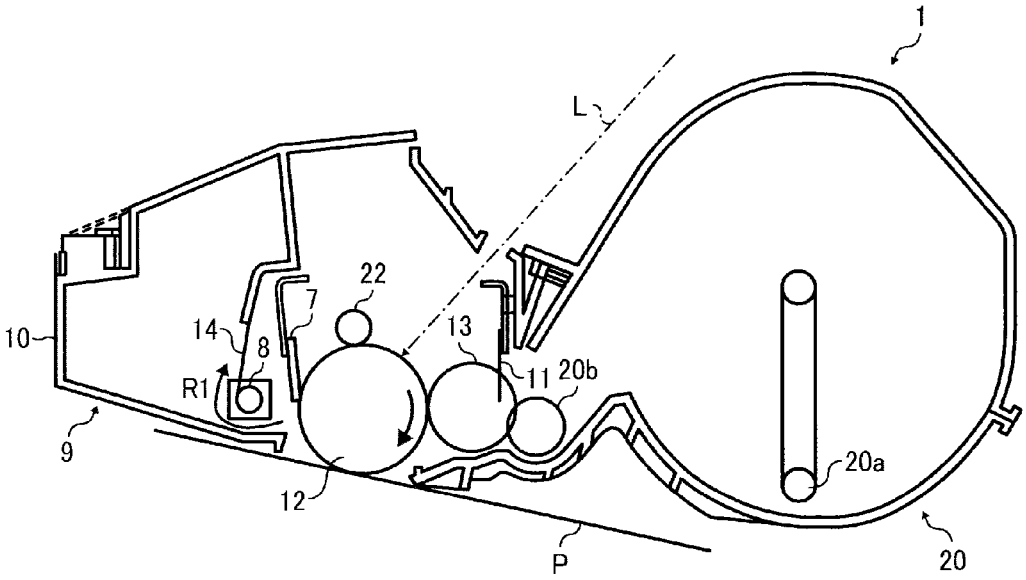
FIG. 2 is a vertical sectional view of a process cartridge installed in the image forming apparatus shown in FIG. 1.

With reference to FIG. 2, a detailed description is now given of a construction of the process cartridge 1 incorporated in the image forming apparatus 100 described above.

FIG. 2 is a vertical sectional view of the process cartridge 1 at substantially a center in a longitudinal direction or an axial direction thereof. The process cartridge 1 includes a photoconductor 12 serving as an image carrier that carries an electrostatic latent image and a resultant toner image, a charging roller 22 serving as a charger, a development device 20, and a cleaner 9.

The development device 20 includes a development roller 13 serving as a developer carrier that contacts the photoconductor 12 to supply toner thereto; a regulator blade 11 serving as a developer regulator that regulates an amount of toner carried on the development roller 13; a supply roller 20*b* that supplies toner to the development roller 13; and an agitator 20*a* that supplies toner to the supply roller 20*b* while agitating it. The cleaner 9 includes a cleaning blade 7 that scrapes residual toner not transferred onto the recording medium P and therefore remaining on the photoconductor 12 off the photoconductor 12.

With reference to FIGS. 1 and 2, a description is provided of an operation of the image forming apparatus 100 to form a toner image on a recording medium P.

As a driver drives and rotates the cylindrical photoconductor 12 clockwise in FIG. 2, the charging roller 22 uniformly charges a photosensitive layer of the photoconductor 12 constituting an outer circumferential surface of the photoconductor 12 at a high potential. The exposure device 2 emits a laser beam L onto the charged photosensitive layer of the photoconductor 12 according to image data sent from an external device such as a client computer, thus forming an electrostatic latent image made of a decreased potential section produced by the laser beam L and an initial increased potential section thereon. As the decreased potential section or the increased potential section of the electrostatic latent image formed on the photoconductor 12 reaches a development position where the development roller 13 is disposed opposite the photoconductor 12, toner moves from a thin, surface toner layer of the development roller 13 to the photoconductor 12, thus visualizing the electrostatic latent image formed on the photoconductor 12 as a toner image. The transfer roller 3 transfers the toner image formed on the photoconductor 12 onto a recording medium P conveyed from the paper tray 4 through the registration roller pair 6.

The fixing device 5 fixes the toner image on the recording medium P. Thereafter, the recording medium P bearing the fixed toner image is discharged onto an outside of the image forming apparatus 100. After transfer of the toner image from the photoconductor 12 onto the recording medium P, the cleaning blade 7 of the cleaner 9 removes residual toner, that is, waste toner, not transferred onto the recording medium P and therefore remaining on the photoconductor 12 therefrom. A discharger disposed downstream from the cleaning blade 7 in a rotation direction of the photoconductor 12 discharges the outer circumferential surface of the photoconductor 12. Thereafter, the charging roller 22 disposed downstream from the discharger in the rotation direction of the photoconductor 12 uniformly charges the photoconductor 12 at the high potential again. The waste toner removed by the cleaning blade 7 is conveyed by a conveyance member 8 rotating in a rotation direction R1 from the cleaning blade 7 to a waste toner container 10 and is stored there. For example, the conveyance member 8 has an outer circumferential surface with various distances from a rotation shaft to an outer circumference thereof. The process cartridge 1 incorporates the photoconductor 12, the charging roller 22, the development device 20, and the cleaner 9 cased in housing.

Figure 3:
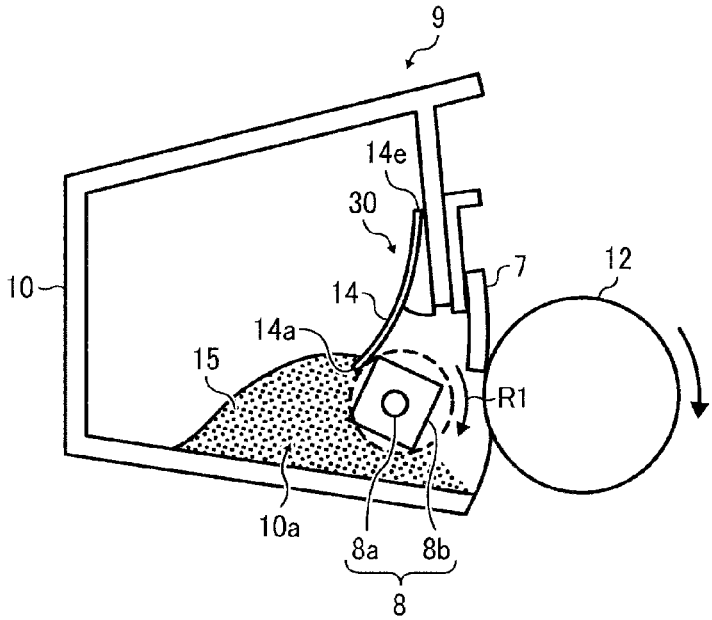
FIG. 3 is a schematic vertical sectional view of a cleaner installed in the process cartridge shown in FIG. 2 illustrating a toner conveyor incorporated therein.

With reference to FIG. 3, a detailed description is now given of a construction of the cleaner 9 incorporated in the process cartridge 1 described above.

FIG. 3 is a schematic vertical sectional view of the cleaner 9. The cleaner 9 includes the cleaning blade 7 in contact with the photoconductor 12; the waste toner container 10 that contains waste toner 15; and a toner conveyor 30 that conveys the waste toner 15 removed from the photoconductor 12 by the cleaning blade 7 to the waste toner container 10. The toner conveyor 30 includes the noncircular conveyance member 8 in cross-section disposed at an opening of the waste toner container 10 situated below the cleaning blade 7. For example, the noncircular conveyance member 8 may be an ellipse, a polygon, a multi angular prism such as a quadrangular prism, a pentaprism, and a hexagonal prism, or the like. According to this exemplary embodiment, the conveyance member 8 is a quadrangular prism. Alternatively, the conveyance member 8 may have other shapes.

The toner conveyor 30 further includes a scraper blade 14, that is, a metal plate, serving as a scraper that scrapes the waste toner 15 off the conveyance member 8. For example, one end of the scraper blade 14 in a vertical direction, that is, a fixed end 14*e*, is attached to an interior wall of the waste toner container 10; another end of the scraper blade 14 in the vertical direction, that is, a free end 14*a*, is in contact with the conveyance member 8. Since the conveyance member 8 has various diameters from a rotation shaft 8*a* to an outer circumference 8*b*, as the conveyance member 8 rotates clockwise in FIG. 3 in the rotation direction R1, the scraper blade 14 is elastically deformable in accordance with variation in the diameter of the conveyance member 8 in contact with the scraper blade 14. Thus, the scraper blade 14 constantly contacts the conveyance member 8. As the conveyance member 8 rotates in the rotation direction R1, the free end 14*a*, serving as a contact end, of the scraper blade 14 contacts the conveyance member 8 in a counter direction counter to the rotation direction R1 of the conveyance member 8. Thus, the free end 14*a* of the scraper blade 14 scrapes the waste toner 15 off the conveyance member 8.

Additionally, the free end 14*a* of the scraper blade 14 contacting the conveyance member 8 blocks movement of the waste toner 15 accumulated in the waste toner container 10 toward the cleaning blade 7. For example, if the waste toner 15 accumulates inside the waste toner container 10 to a height where the waste toner 15 comes into contact with the scraper blade 14, the scraper blade 14 receives pressure from the waste toner 15. When the free end 14*a* of the scraper blade 14 contacts the conveyance member 8 in a trailing direction with respect to the rotation direction R1 of the conveyance member 8, the waste toner 15 accumulated in the waste toner container 10 exerts pressure to the scraper blade 14 in a direction that separates the free end 14*a* of the scraper blade 14 from the conveyance member 8. As a result, the scraper blade 14 comes into contact with the conveyance member 8 with decreased pressure therebetween and therefore does not scrape the waste toner 15 off the conveyance member 8 properly. Conversely, when the free end 14*a* of the scraper blade 14 contacts the conveyance member 8 in the counter direction counter to the rotation direction R1 of the conveyance member 8, the waste toner 15 accumulated in the waste toner container 10 exerts pressure to the scraper blade 14 in a direction that increases pressure between the scraper blade 14 and the conveyance member 8, maintaining desired pressure between the scraper blade 14 and the conveyance member 8 that allows the scraper blade 14 to scrape the waste toner 15 off the conveyance member 8 properly over time.

As the conveyance member 8 rotates in the rotation direction R1, the conveyance member 8 conveys the waste toner 15 scraped off the photoconductor 12 to the waste toner container 10. The waste toner 15 scraped off the conveyance member 8 by the scraper blade 14 is collected into the waste toner container 10.

Figure 4:
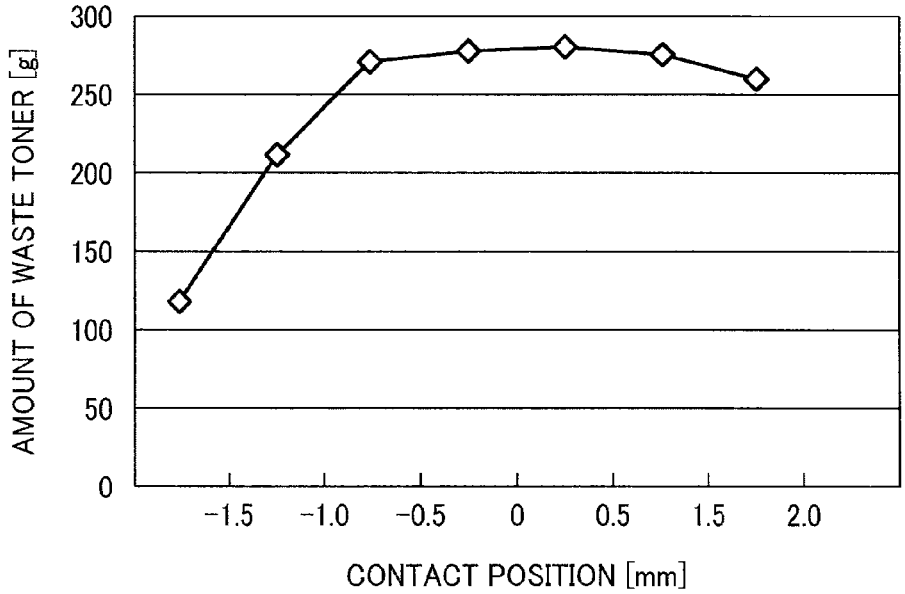
FIG. 4 is a graph illustrating a relation between a contact position on a conveyance member contacted by a scraper blade incorporated in the cleaner shown in FIG. 3 and an amount of waste toner.
Figure 5:
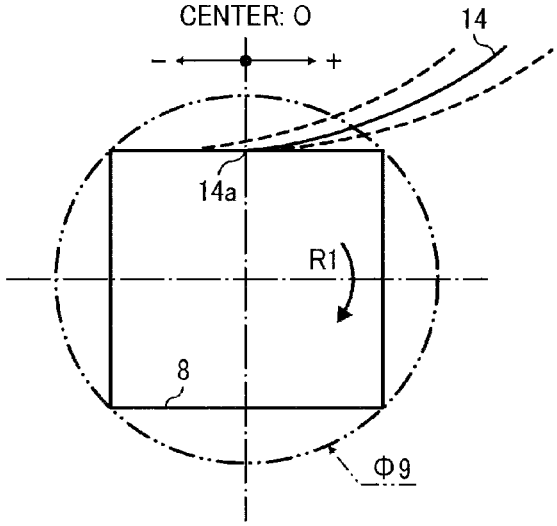
FIG. 5 is a vertical sectional view of the conveyance member and the scraper blade illustrating the contact position where the scraper blade contacts the conveyance member.

With reference to FIGS. 4 and 5, a description is provided of measurement for measuring an amount of the waste toner 15 accommodated in the waste toner container 10 that varies depending on a contact position on the conveyance member 8 contacted by the scraper blade 14.

FIG. 4 is a graph illustrating a relation between the contact position on the conveyance member 8 contacted by the free end 14*a* of the scraper blade 14 and the amount of the waste toner 15 accommodated by the waste toner container 10 when the conveyance member 8 is at a default position. FIG. 5 is a vertical sectional view of the conveyance member 8 and the scraper blade 14 illustrating the contact position where the scraper blade 14 contacts the conveyance member 8.

As shown in FIG. 5, measurement is performed with a quadrangular prism having a side of about 9 mm used as the conveyance member 8. The contact position on the conveyance member 8 contacted by the free end 14*a* of the scraper blade 14 when the conveyance member 8 is at the default position is indicated as plus and minus with respect to zero defining a center on an outer surface of the conveyance member 8. For example, the contact position disposed downstream from the center in the rotation direction R1 of the conveyance member 8, that is, the contact position situated closer to the cleaning blade 7 depicted in FIG. 3 is defined by plus. Conversely, the contact position disposed upstream from the center in the rotation direction R1 of the conveyance member 8, that is, the contact position situated closer to the waste toner container 10 is defined by minus. The amount of the waste toner 15 accommodated in the waste toner container 10 defines an amount of the waste toner 15 removed from the photoconductor 12 by the cleaning blade 7 depicted in FIG. 3 and accommodated in the waste toner container 10. That is, the waste toner 15 accommodated in the waste toner container 10 excludes the waste toner 15 not collected into the waste toner container 10 and therefore adhering to the photoconductor 12 again without being caught by the cleaning blade 7, which may form a faulty toner image on the photoconductor 12. The default position of the conveyance member 8 defines a position of the conveyance member 8 where the conveyance member 8 minimizes an amount of elastic deformation of the scraper blade 14.

As shown in FIG. 4, when the contact position where the free end 14*a* of the scraper blade 14 contacts the conveyance member 8 is zero, that is, when the free end 14*a* of the scraper blade 14 is at the center or the vicinity of the center on the outer surface of the conveyance member 8 while the conveyance member 8 is at the default position, the maximum amount of the waste toner 15 is accommodated in the waste toner container 10. On the other hand, when the contact position where the free end 14*a* of the scraper blade 14 contacts the conveyance member 8 is minus, that is, when the free end 14*a* of the scraper blade 14 is upstream from the center on the outer surface of the conveyance member 8 in the rotation direction R1 of the conveyance member 8, a decreased amount of the waste toner 15 is accommodated in the waste toner container 10.

Conversely, when the contact position where the free end 14*a* of the scraper blade 14 contacts the conveyance member 8 is plus, that is, when the free end 14*a* of the scraper blade 14 is downstream from the center on the outer surface of the conveyance member 8 in the rotation direction R1 of the conveyance member 8, the scraper blade 14 becomes entangled with the conveyance member 8 rotating in the rotation direction R1 and therefore does not work. For example, when the contact position is downstream from the center on the outer surface of the conveyance member 8 by 2 mm, the scraper blade 14 is entangled with the rotating conveyance member 8 and therefore measurement is impossible. To address this circumstance, it is desirable to bring the free end 14*a* of the scraper blade 14 into contact with the center or the vicinity of the center on the outer surface of the conveyance member 8, that is, a region on the outer surface of the conveyance member 8 within about 0.5 mm from the center on the outer surface of the conveyance member 8 in the rotation direction R1 of the conveyance member 8.

Figure 6A:
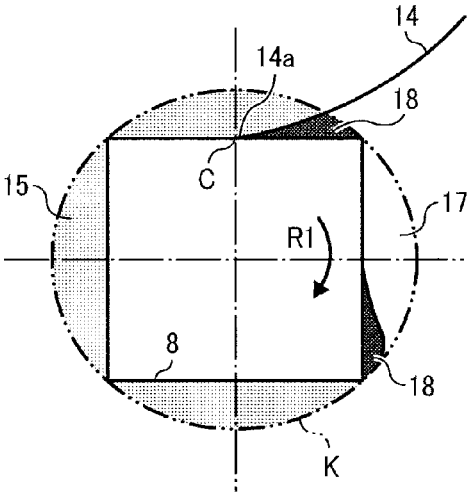
FIG. 6A is a vertical sectional view of the scraper blade and the conveyance member in a state in which the scraper blade contacts a center or the vicinity of the center on an outer surface of the conveyance member.
Figure 6B:
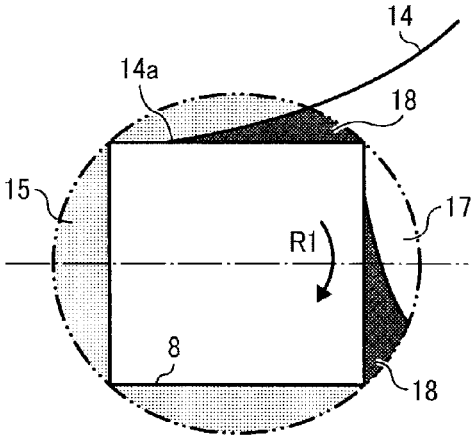
FIG. 6B is a vertical sectional view of the scraper blade and the conveyance member in a state in which the scraper blade contacts an upstream section on the outer surface of the conveyance member.

With reference to FIGS. 6A and 6B, a description is provided of a contact state in which the free end 14*a* of the scraper blade 14 contacts the conveyance member 8.

FIG. 6A is a vertical sectional view of the scraper blade 14 and the conveyance member 8 in a state in which the free end 14*a* of the scraper blade 14 contacts the center or the vicinity of the center on the outer surface of the conveyance member 8. FIG. 6B is a vertical sectional view of the scraper blade 14 and the conveyance member 8 in a state in which the free end 14*a* of the scraper blade 14 contacts an upstream section on the outer surface of the conveyance member 8 upstream from the center in the rotation direction R1 of the conveyance member 8.

The conveyance member 8 conveys the waste toner 15 situated inside a circumcircle K of the quadrangular prism of the conveyance member 8. However, if there is adhered waste toner 18 not scraped off the conveyance member 8 by the scraper blade 14 and thereby adhered to the conveyance member 8, the adhered waste toner 18 decreases a conveyance region 17 to be occupied by the waste toner 15 conveyed by the conveyance member 8, thus decreasing an amount of the waste toner 15 conveyed by the conveyance member 8. As shown in FIG. 6B, when the free end 14*a* of the scraper blade 14 contacts the upstream section on the outer surface of the conveyance member 8 upstream from the center in the rotation direction R1 of the conveyance member 8, an amount of the adhered waste toner 18 increases compared to when the free end 14*a* of the scraper blade 14 contacts the center or the vicinity of the center on the outer surface of the conveyance member 8 as shown in FIG. 6A.

Figure 7A:
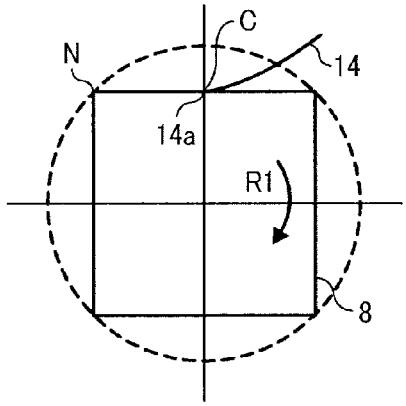
FIG. 7A is a vertical sectional view of the scraper blade and the conveyance member in a state in which the scraper blade contacts the center on the outer surface of the conveyance member.
Figure 7B:
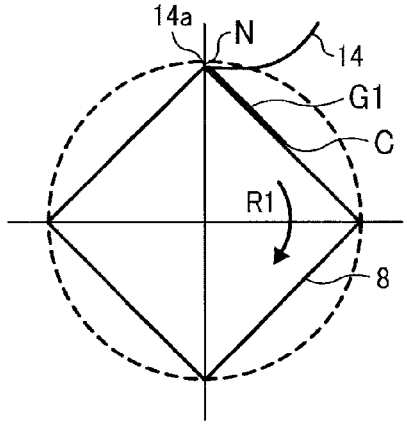
FIG. 7B is a vertical sectional view of the scraper blade and the conveyance member in a state in which the scraper blade contacts a corner on the outer surface of the conveyance member.
Figure 7C:
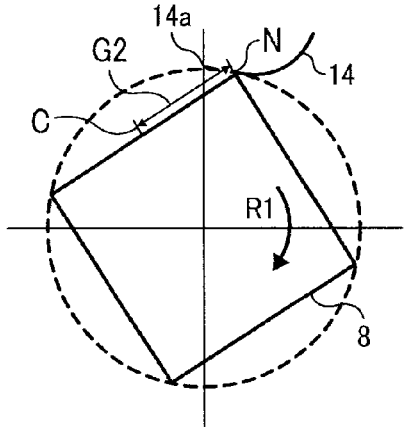
FIG. 7C is a vertical sectional view of the scraper blade and the conveyance member in a state in which the scraper blade is lifted by the corner on the outer surface of the conveyance member.

With reference to FIGS. 7A, 7B, and 7C, a description is provided of a reason why the amount of the adhered waste toner 18 increases when the free end 14*a* of the scraper blade 14 contacts the upstream section on the outer surface of the conveyance member 8.

As shown in FIGS. 7A and 7B, until the free end 14*a* of the scraper blade 14 reaches a corner N of the conveyance member 8 as the conveyance member 8 rotates in the rotation direction R1, the free end 14*a* of the scraper blade 14 slides over a slide region G1 on the outer surface of the conveyance member 8, thus scraping the waste toner 15 off the conveyance member 8 properly. As the conveyance member 8 further rotates in the rotation direction R1 from a position shown in FIG. 7B, the corner N of the conveyance member 8 slides over a lower face of the scraper blade 14 as shown in FIG. 7C, thus separating the free end 14*a* of the scraper blade 14 from the conveyance member 8. As the conveyance member 8 further rotates in the rotation direction R1 from a position shown in FIG. 7C to a position shown in FIG. 7A, the free end 14*a* of the scraper blade 14 comes into contact with another side of the conveyance member 8.

As the conveyance member 8 rotates from the position shown in FIG. 7A where the free end 14*a* of the scraper blade 14 contacts a center C on the outer surface of one side of the conveyance member 8 in the rotation direction R1 thereof to the position shown in FIG. 7B where the free end 14*a* of the scraper blade 14 contacts the corner N, the free end 14*a* of the scraper blade 14 scrapes the waste toner 15 off the conveyance member 8 in the slide region G1 provided between the center C and the corner N disposed upstream from the center C in the rotation direction R1 of the conveyance member 8. Conversely, since the scraper blade 14 is lifted by the corner N of the conveyance member 8 as shown in FIG. 7C, the free end 14*a* of the scraper blade 14 is isolated from the conveyance member 8 in a non-slide region G2 provided between the corner N and the center C on the outer surface of another side of the conveyance member 8 and therefore does not scrape the waste toner 15 off the non-slide region G2 of the conveyance member 8. Accordingly, as shown in FIG. 6A, the adhered waste toner 18 adheres to the conveyance member 8 in the non-slide region G2 provided between the corner N disposed downstream from the center C in the rotation direction R1 of the conveyance member 8 and the center C. As shown in FIG. 6B, when the free end 14*a* of the scraper blade 14 contacts the conveyance member 8 in the upstream section on the outer surface of the conveyance member 8 upstream from the center C in the rotation direction R1 of the conveyance member 8, the adhered waste toner 18 adhered to the conveyance member 8 in a region downstream from the contact position on the outer surface of the conveyance member 8 where the free end 14*a* of the scraper blade 14 contacts the conveyance member 8 in the rotation direction R1 of the conveyance member 8 is not scraped off the conveyance member 8 by the free end 14*a* of the scraper blade 14. Accordingly, a greater amount of the adhered waste toner 18 adheres to the conveyance member 8 compared to when the free end 14*a* of the scraper blade 14 contacts the center C on the outer surface of the conveyance member 8 as shown in FIG. 6A.

Figure 8A:
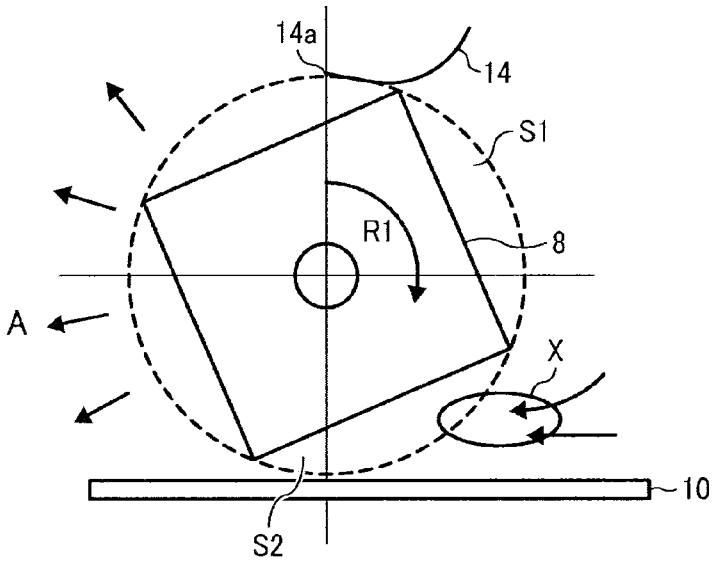
FIG. 8A is a vertical sectional view of the scraper blade and the conveyance member in a state in which the conveyance member creates space thereunder.
Figure 8B:
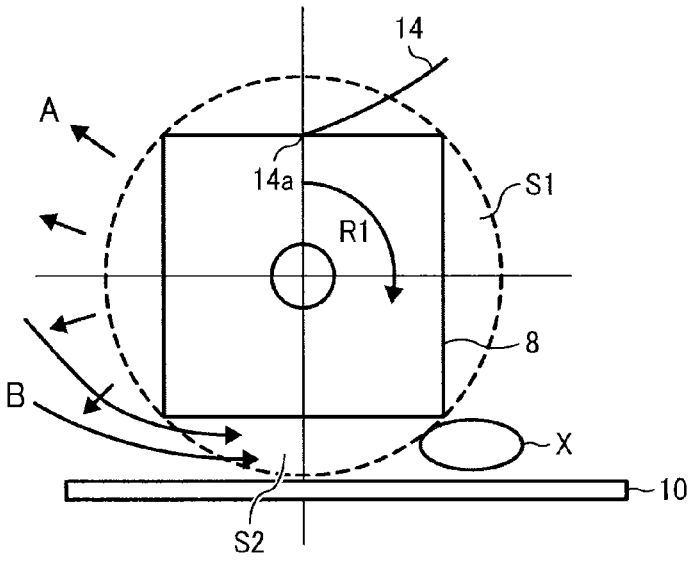
FIG. 8B is a vertical sectional view of the scraper blade and the conveyance member in a state in which waste toner enters the space created under the conveyance member shown in FIG. 8A.

With reference to FIGS. 8A and 8B, a description is provided of a reason why an amount of the waste toner 15 accommodated in the waste toner container 10 decreases as an amount of the waste toner 15 conveyed by the conveyance member 8 decreases.

As shown in FIG. 2, the cleaning blade 7 comes into contact with the photoconductor 12 by gravity. As shown in FIG. 1, the transfer roller 3 is situated below a contact position where the cleaning blade 7 contacts the photoconductor 12. As shown in FIG. 2, below the cleaner 9 is a conveyance path through which a recording medium P is conveyed. Hence, there is only a limited amount of space between the conveyance member 8 situated below the cleaning blade 7 and the conveyance path. To address this circumstance, the waste toner container 10 accommodates space above the conveyance member 8. Accordingly, as the waste toner 15 accumulates inside the waste toner container 10, the conveyance member 8 rotating in the rotation direction R1, with its sides facing the waste toner container 10, pushes the waste toner 15 in a direction A toward an inner part of the waste toner container 10, moving the waste toner 15 upward to the space above the conveyance member 8 and thus creating a space S2 as shown in FIG. 8A. Simultaneously, the scraper blade 14 scrapes the waste toner 15 off the conveyance member 8, thus creating a space S1. The conveyance member 8, with its side disposed upstream from the sides facing the waste toner container 10 in the rotation direction R1, conveys waste toner X scraped off the photoconductor 12 by the cleaning blade 7 (depicted in FIG. 3) and fallen between the conveyance member 8 and the photoconductor 12 to the space S2, thus conveying the waste toner 15 to the waste toner container 10.

As the waste toner 15 accumulates inside the waste toner container 10, the accumulated waste toner 15 generates pressure that moves itself toward the conveyance member 8 through an opening 10*a* of the waste toner container 10 depicted in FIG. 3. Accordingly, as shown in FIG. 8B, the waste toner 15 moves in a direction B from the waste toner container 10 to the space S2 created by the conveyance member 8 that pushes the waste toner 15 in the direction A toward the waste toner container 10, thus filling in the space S2. As an amount of the waste toner 15 contained in the waste toner container 10 increases, the waste toner 15 moves from the waste toner container 10 toward the conveyance member 8 through the opening 10*a* with an increased force, thus gradually increasing an amount of the waste toner 15 entering the space S2 per unit hour. Eventually, even if the conveyance member 8, with its sides facing the waste toner container 10, pushes the waste toner 15 toward the waste toner container 10 to create the space S2, the waste toner 15 entering the space S2 pushes away the waste toner X scraped off the photoconductor 12 by the cleaning blade 7. Accordingly, the waste toner X is not conveyed to the waste toner container 10. Consequently, the waste toner X scraped off the photoconductor 12 by the cleaning blade 7 accumulates between the photoconductor 12 and the conveyance member 8. As the waste toner X accumulated between the photoconductor 12 and the conveyance member 8 comes into contact with the photoconductor 12, it adheres to the photoconductor 12 again without being caught by the cleaning blade 7.

Further, as the waste toner X accumulates between the photoconductor 12 and the conveyance member 8, the cleaning blade 7 is required to catch a greater amount of the waste toner X with its edge. However, if the amount of the waste toner X exceeds a predetermined limit, the cleaning blade 7 no longer catches the waste toner X, allowing the waste toner X in bulk to slip through between the photoconductor 12 and the cleaning blade 7.

As the waste toner X slips through between the photoconductor 12 and the cleaning blade 7, the waste toner X on the photoconductor 12 adheres to and stains the charging roller 22 depicted in FIG. 2. The stained charging roller 22 does not charge the outer circumferential surface of the photoconductor 12 uniformly at a predetermined voltage, resulting in formation of a faulty toner image such as a white spotted image. Further, as the waste toner X moves to the transfer roller 3 in accordance with rotation of the photoconductor 12, the waste toner X is transferred from the photoconductor 12 onto a recording medium P, resulting in formation of a faulty toner image such as a black spotted image. Thus, the waste toner X slipping through between the photoconductor 12 and the cleaning blade 7 forms various faulty toner images.

As the amount of the waste toner 15 conveyed by the conveyance member 8 decreases, the amount of the waste toner 15 pushed away by the conveyance member 8 decreases. Accordingly, the conveyance member 8 does not decrease the force of the waste toner 15 entering the space S2 created by the conveyance member 8 that pushes away the waste toner 15 toward the waste toner container 10, allowing the waste toner 15 to enter the space S2 with an increased force. Consequently, the waste toner 15 entering the space S2 while a smaller amount of the waste toner 15 is collected into the waste toner container 10 at an early stage pushes back the waste toner X scraped off the photoconductor 12 by the cleaning blade 7, preventing the waste toner X from moving toward the waste toner container 10. Thus, with a configuration shown in FIG. 6B in which the free end 14*a* of the scraper blade 14 contacts the upstream section on the outer surface of the conveyance member 8 upstream from the center C in the rotation direction R1 of the conveyance member 8, the conveyance member 8 conveys a decreased amount of the waste toner 15 to the waste toner container 10 compared to a configuration shown in FIG. 6A in which the free end 14*a* of the scraper blade 14 contacts the center C on the outer surface of the conveyance member 8.

Generally, the scraper blade 14 is made of an elastic film such as polyethylene terephthalate (PET) sheet. However, when the PET sheet is bent and heated, it is subject to gradual plastic deformation (e.g., creep strain), causing a problem of decreasing pressure between the scraper blade 14 and the conveyance member 8.

With reference to FIGS. 9A, 9B, 9C, and 9D, a description is provided of permanent bending of the scraper blade 14 and change of the contact position where the free end 14*a* of the scraper blade 14 contacts the conveyance member 8.

Figure 9A:
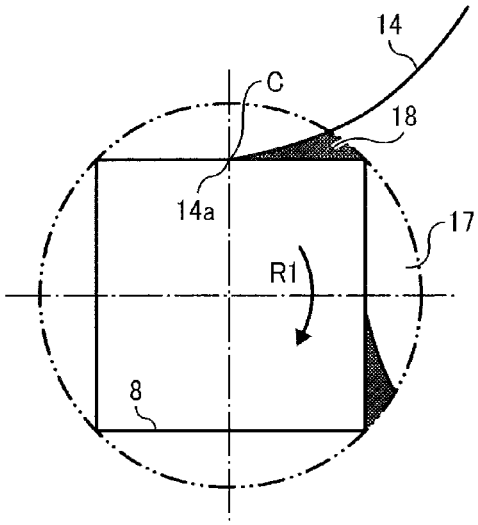
FIG. 9A is a vertical sectional view of the scraper blade and the conveyance member in a state in which the scraper blade contacts the center on the outer surface of the conveyance member.
Figure 9B:
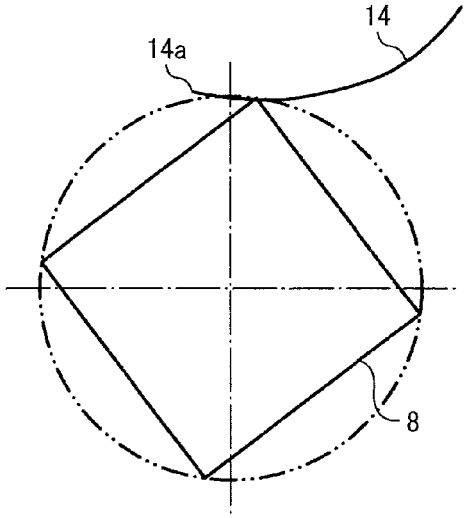
FIG. 9B is a vertical sectional view of the scraper blade and the conveyance member in a state in which the scraper blade is bent by the conveyance member substantially.
Figure 9C:
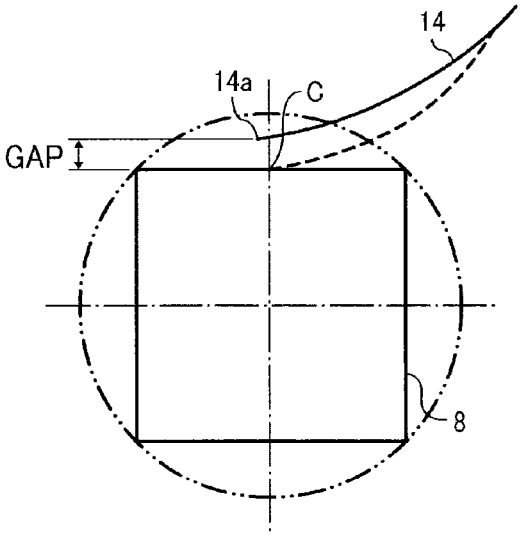
FIG. 9C is a vertical sectional view of the scraper blade and the conveyance member in a state in which the scraper blade is isolated from the conveyance member.
Figure 9D:
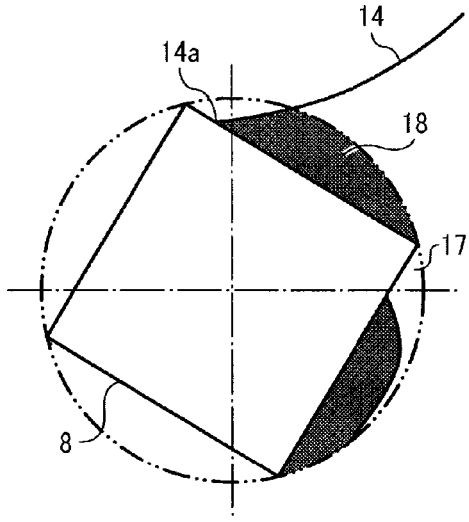
FIG. 9D is a vertical sectional view of the scraper blade and the conveyance member in a state in which the scraper blade contacts the outer surface of the conveyance member in a decreased area.

As shown in FIG. 9A, even if the scraper blade 14 is configured to contact the center C or the vicinity of the center C on the outer surface of the conveyance member 8 by default, after the scraper blade 14 remains in contact with the conveyance member 8 during long term storage, the free end 14*a* of the scraper blade 14 contacts the conveyance member 8 with decreased pressure therebetween although contacting the same center C or the vicinity of the center C on the outer surface of the conveyance member 8. As shown in FIG. 9B, if the scraper blade 14 remains in contact with the conveyance member 8 at a position where bending of the scraper blade 14 is maximized under high temperature during long term storage, the scraper blade 14 is subject to permanent bending. Accordingly, as shown in FIG. 9C, the free end 14*a* of the scraper blade 14 may be levitated from the center C on the outer surface of the conveyance member 8 with a gap therebetween by default. Consequently, as shown in FIG. 9D, the free end 14*a* of the scraper blade 14 contacts a decreased area on the outer surface on the conveyance member 8 and therefore scrapes a decreased amount of the waste toner 15 off the conveyance member 8. As a result, the decreased amount of the waste toner 15 is collected into the waste toner container 10.

To address this problem, the scraper blade 14 is made of a metal material, instead of a polymeric material such as an elastic film, not subject to creep strain, thus preventing the scraper blade 14 from scraping a decreased amount of the waste toner 15 off the conveyance member 8 due to creep strain of the scraper blade 14. The metal material has enhanced bending strength and mechanical strength compared to an elastic film. Generally, a PET material has a bending strength of about 70 Mpa at ambient temperature and an SUS stainless steel plate spring has a bending strength of about 390 Mpa at ambient temperature. That is, the SUS stainless steel plate spring has a bending strength five times or more as great as the PET material. Since the bending strength of the elastic film decreases at high temperature, it is subject to creep strain. By contrast, the bending strength of the metal material does not decrease even at high temperature. That is, the metal material has enhanced durability against creep strain compared to the elastic film. However, since the metal material has an increased rigidity, as the metal scraper blade 14 contacting the conveyance member 8 is elastically deformed in accordance with rotation of the conveyance member 8, the metal scraper blade 14 contacts the conveyance member 8 with unnecessarily increased pressure therebetween. The unnecessarily increased pressure between the metal scraper blade 14 and the conveyance member 8 causes problems of wearing the outer surface of the conveyance member 8, increasing rotation load of the conveyance member 8, and generating noise whenever the metal scraper blade 14 comes into contact with each outer surface of the rotating conveyance member 8.

Generally, the conveyance member 8 is made of resin to facilitate processing. If the scraper blade 14 is made of a rigid metal material, as the scraper blade 14 contacts the conveyance member 8, the free end 14*a* of the metal scraper blade 14 may shave the conveyance member 8.

Figure 10:
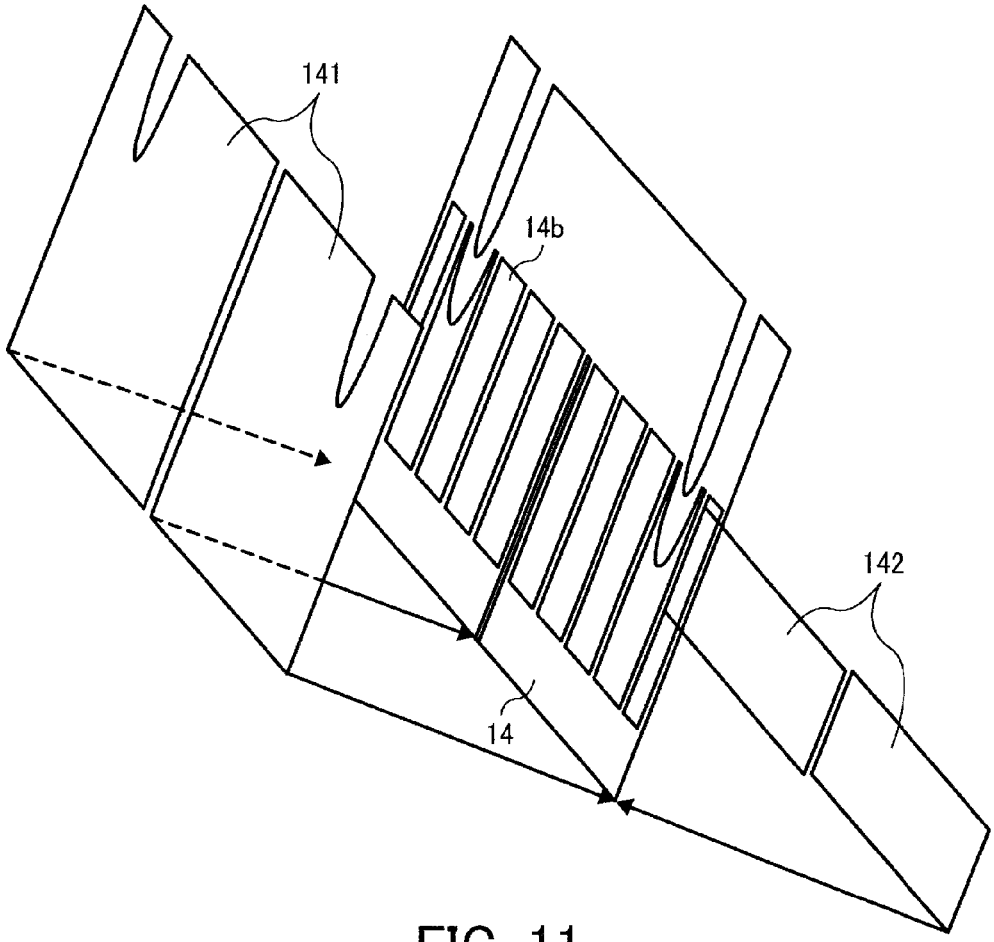
FIG. 10 is an exploded perspective view of the scraper blade incorporated in the toner conveyor shown in FIG. 3 according to a first exemplary embodiment of the present invention.
Figure 11:
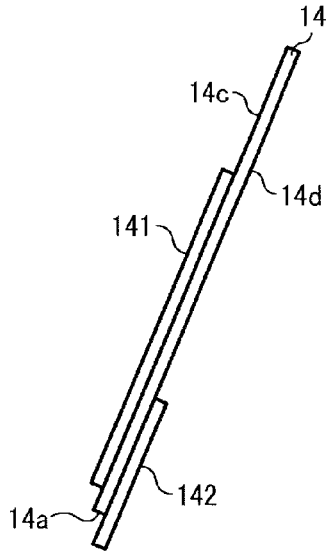
FIG. 11 is a side view of the scraper blade shown in FIG. 10.

To address this problem, the scraper blade 14 has a configuration that decreases its rigidity as described below with reference to FIGS. 10 and 11. FIG. 10 is an exploded perspective view of the scraper blade 14 according to a first exemplary embodiment. FIG. 11 is a side view of the scraper blade 14. As shown in FIG. 10, the scraper blade 14 is made of a metal material such as SUS stainless steel and produced with a plurality of through-holes 14*b* that decreases the rigidity of the scraper blade 14. The scraper blade 14 is elastically deformed or bent for a predetermined amount to slide over the conveyance member 8 so that the scraper blade 14 contacts the conveyance member 8 with desired pressure therebetween. For example, a bent region of the scraper blade 14 produced with the through-holes 14*b* is bent but bending of other region of the scraper blade 14 having an increased section modulus is negligible. Hence, by adjusting the shape of the through-holes 14*b*, the scraper blade 14 is bent in a predetermined amount and therefore brought into contact with the conveyance member 8 with desired pressure therebetween.

The through-holes 14*b* are covered with a lid 141 made of an elastic film (e.g., a PET sheet) to prevent the waste toner 15 contained in the waste toner container 10 from entering the through-holes 14*b*. The lid 141 has a size great enough to cover the through-holes 14*b* produced through the scraper blade 14. As shown in FIG. 11, the lid 141 is attached to the scraper blade 14 with an adhesive such as double-faced tape on a toner carrying face 14*c* of the scraper blade 14 that contacts the waste toner 15 contained in the waste toner container 10, that is, a face opposite an opposed face 14*d* of the scraper blade 14 that faces the conveyance member 8 depicted in FIG. 3.

The lid 141 deforms in accordance with elastic deformation of the scraper blade 14. However, if the rigidity of the lid 141 is great, resiliency of the lid 141 increases pressure between the scraper blade 14 and the conveyance member 8. To address this problem, the Young's modulus of the lid 141 is smaller than that of the scraper blade 14 or the plate thickness of the lid 141 is smaller than that of the scraper blade 14, thus rendering the rigidity of the lid 141 to be smaller than that of the scraper blade 14. Additionally, the load required to bend the lid 141 for a predetermined amount is one tenth or smaller of the load to bend the scraper blade 14 for the identical predetermined amount.

The lid 141 covering the through-holes 14*b*, even if the waste toner 15 accumulated inside the waste toner container 10 contacts the scraper blade 14, prevents the waste toner 15 from returning to the cleaning blade 7 or the vicinity thereof through the through-holes 14*b*. Accordingly, the lid 141 prevents the waste toner 15 from the waste toner container 10 from entering and filling in space enclosed by the cleaning blade 7, the photoconductor 12, the conveyance member 8, and the scraper blade 14 depicted in FIG. 3 through the through-holes 14*b*. Consequently, the waste toner 15 scraped off the photoconductor 12 by the cleaning blade 7 moves toward the conveyance member 8 without being blocked by the waste toner 15 filling in the space enclosed by the cleaning blade 7, the photoconductor 12, the conveyance member 8, and the scraper blade 14. That is, the waste toner 15 is caught by the cleaning blade 7 and therefore removed from the photoconductor 12 properly.

As shown in FIG. 11, the opposed face 14*d* of the scraper blade 14 that faces the conveyance member 8 is attached with a contact member 142 made of an elastic film (e.g., a PET sheet) with an adhesive such as double-faced tape in such a manner that a part of the contact member 142 projects beyond the free end 14*a* of the scraper blade 14. For example, the contact member 142 projects beyond the free end 14*a* of the scraper blade 14 in an amount of about 1 mm or smaller so that elastic deformation or bending of the contact member 142 does not adversely affect pressure between the scraper blade 14 and the conveyance member 8.

Since the contact member 142 projects beyond the free end 14*a* of the scraper blade 14, the contact member 142 made of an elastic film less rigid than a metal material contacts the conveyance member 8. Hence, the contact member 142 does not shave the conveyance member 8, extending the life of the conveyance member 8.

Table 1 below shows specifications of the scraper blade 14.

TABLE 1

| | |
|---|---|
| Free length | 13 mm |
| Young's modulus | 200 GPa |
| Blade width | 226 mm |
| Opening ratio | 79% |
| Plate spring length | 48 mm |
| Plate thickness | 0.1 mm |
| Bending | 1.1 mm |

In Table 1, opening ratio defines a ratio of a total width of the plurality of through-holes 14*b* with respect to a total width of the scraper blade 14 in a longitudinal direction of the scraper blade 14 parallel to an axial direction of the conveyance member 8. Free length defines a length of each through-hole 14*b* in a short direction of the scraper blade 14 orthogonal to the longitudinal direction thereof. Blade width defines a width of the scraper blade 14 in the longitudinal direction thereof. Plate spring length defines a length of the scraper blade 14 in the short direction thereof. For example, it is preferable that the opening ratio is in a range of from about 50 percent to about 90 percent. If the opening ratio is smaller than about 50 percent, the rigidity of the scraper blade 14 increases and therefore the scraper blade 14 contacts the conveyance member 8 with pressure greater than desired pressure when the scraper blade 14 is elastically deformed or bent in a predetermined amount to slide over the rotating conveyance member 8. Conversely, if the opening ratio exceeds about 90 percent, the rigidity of the scraper blade 14 decreases and therefore the scraper blade 14 is bent and subject to plastic deformation before the scraper blade 14 is elastically deformed or bent in a predetermined amount to slide over the rotating conveyance member 8.

Pressure with which the scraper blade 14 contacts the conveyance member 8 is calculated by a cantilever formula (1) below. According to this exemplary embodiment, pressure P is about 1.2 N.

$$P = \frac{Ebh}{4L^3}\delta \tag{1}$$

The lid 141 is made of PET having a plate thickness identical to that of the scraper blade 14. The lid 141 has the Young's modulus of about 540 Mpa. The load required to bend the lid 141 in a predetermined amount is about one three hundred and seventieth of the load required to bend the scraper blade 14 in the identical predetermined amount. Hence, change in pressure between the scraper blade 14 and the conveyance member 8, that is, resiliency of the lid 141 due to elastic deformation of the lid 141 is sufficiently smaller than change in pressure between the scraper blade 14 and the conveyance member 8 due to elastic deformation of the scraper blade 14 and therefore negligible.

Figure 12:
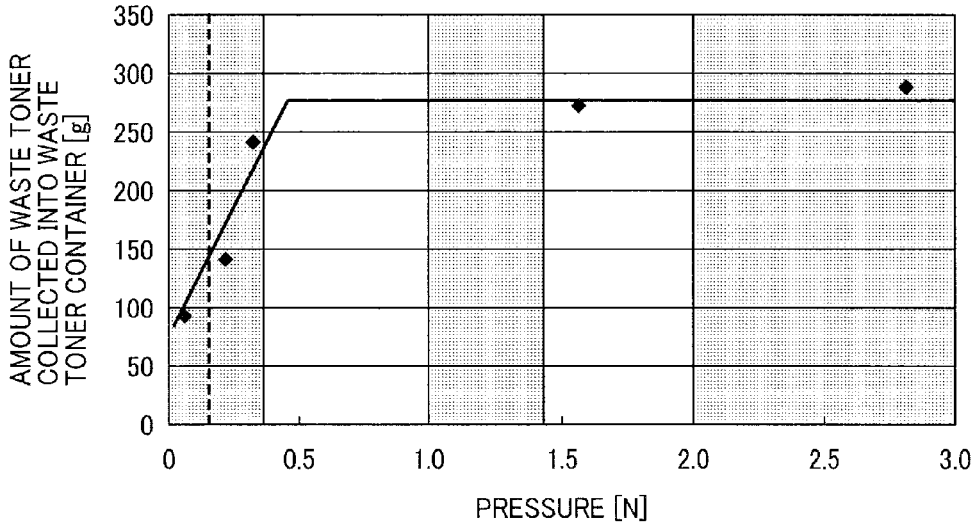
FIG. 12 is a graph illustrating a relation between pressure with which the scraper blade shown in FIG. 11 presses against the conveyance member and an amount of waste toner collected into a waste toner container incorporated in the cleaner shown in FIG. 3.

FIG. 12 is a graph illustrating a relation between pressure with which the scraper blade 14 presses against the conveyance member 8 and an amount of the waste toner 15 collected into the waste toner container 10. The amount of the waste toner 15 collected into the waste toner container 10 is measured until cleaning failure occurs. As shown in FIG. 12, before pressure between the scraper blade 14 and the conveyance member 8 amounts to about 0.5 N, the amount of the waste toner 15 collected into the waste toner container 10 increases proportionately with increase of pressure between the scraper blade 14 and the conveyance member 8. This is because the scraper blade 14 scrapes more waste toner 15 off the conveyance member 8 as the scraper blade 14 presses against the conveyance member 8 with greater pressure. Accordingly, the conveyance member 8 conveys more waste toner 15 into the waste toner container 10. Consequently, more waste toner 15 is collected into the waste toner container 10.

When pressure between the scraper blade 14 and the conveyance member 8 is about 0.5 N, the waste toner container 10 becomes full of the waste toner 15 of about 270 g. When pressure between the scraper blade 14 and the conveyance member 8 exceeds about 2.5 N, noise generates. To address this circumstance, it is preferable that the scraper blade 14 presses against the conveyance member 8 with pressure in a range of from about 1.0 N to about 1.5 N. Even if the scraper blade 14 is made of a rigid metal material and produced with the through-holes 14*b*, the scraper blade 14 presses against the conveyance member 8 in a range of from about 1.0 N to about 1.5 N.

When the scraper blade 14 made of PET is left at high temperatures indefinitely to cause creep strain, pressure between the scraper blade 14 and the conveyance member 8 decreases to about 0.2 N from the desired range of from about 1.0 N to about 1.5 N as shown by the dotted line in FIG. 12, generating early cleaning failure.

Figure 13:
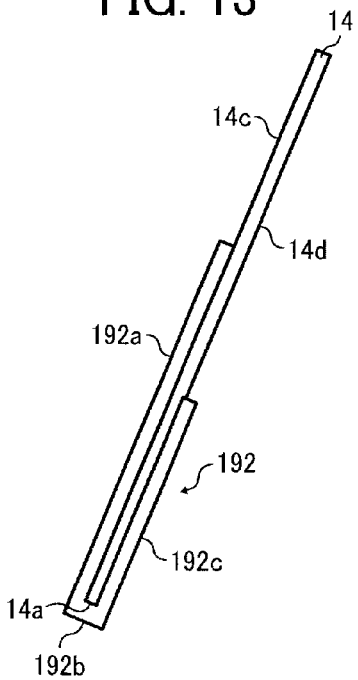
FIG. 13 is a side view of the scraper blade and a lid attached thereto.

With reference to FIG. 13, a description is provided of a configuration of the scraper blade 14 attached with a lid 192 instead of the lid 141 and the contact member 142 shown in FIG. 11.

FIG. 13 is a side view of the scraper blade 14 and the lid 192. As shown in FIG. 13, the lid 192 made of a single elastic film covers the through-holes 14*b* of the scraper blade 14 and at the same time contacts the conveyance member 8 by projecting beyond the free end 14*a* of the scraper blade 14. For example, the lid 192 includes an opposed portion 192*c* attached to the opposed face 14*d* of the scraper blade 14 disposed opposite the conveyance member 8. The lid 192 further includes a contact portion 192*b* folded back at the free end 14*a* of the scraper blade 14 and a lid portion 192*a* attached to the toner carrying face 14*c* of the scraper blade 14 opposite the opposed face 14*d* thereof. The contact portion 192*b* covers the free end 14*a* of the scraper blade 14 and comes into contact with the conveyance member 8. The lid portion 192*a* covers the through-holes 14*b* of the scraper blade 14.

The lid portion 192*a* covering the through-holes 14*b* of the scraper blade 14 prevents the waste toner 15 contained in the waste toner container 10 from entering the through-holes 14*b*. The contact portion 192*b* and the opposed portion 192*c* prevent the scraper blade 14 from shaving the conveyance member 8 as the scraper blade 14 slides over the conveyance member 8.

With reference to FIGS. 1 to 3, 11, and 13, a description is provided of advantages of the toner conveyor 30 described above.

As shown in FIGS. 3 and 11, the toner conveyor 30 includes the noncircular conveyance member 8 that rotates in the rotation direction R1 and conveys the waste toner 15 into the waste toner container 10 and the scraper blade 14 serving as a plate-shaped metal scraper that contacts the conveyance member 8 with predetermined pressure therebetween to scrape the waste toner 15 off the conveyance member 8. The scraper blade 14 is attached with the contact member 142 less rigid than the scraper blade 14 and contacting the conveyance member 8. Accordingly, the scraper blade 14 scrapes the waste toner 15 off the conveyance member 8 without shaving the conveyance member 8, extending the life of the conveyance member 8.

As shown in FIG. 11, the contact member 142 projects beyond the free end 14*a* of the scraper blade 14 by about 1 mm or smaller. Accordingly, bending of the contact member 142 is minimized, thus minimizing decrease in pressure exerted by the scraper blade 14 to the conveyance member 8.

The contact member 142 is made of film. Accordingly, the contact member 142 has a rigidity smaller than that of the scraper blade 14, preventing the contact member 142 from shaving the conveyance member 8.

As shown in FIG. 10, the scraper blade 14 is produced with the through-holes 14*b*. Accordingly, the through-holes 14*b* decrease the rigidity of the metal scraper blade 14 and elastically deform or bend the scraper blade 14 for a predetermined amount that allows the scraper blade 14 to slide over the conveyance member 8, thus preventing the scraper blade 14 from contacting the conveyance member 8 with excessively increased pressure therebetween. Consequently, the scraper blade 14 slides over the conveyance member 8 with minimized noise.

The opening ratio of the through-holes 14*b* is in a range of from about 50 percent to about 90 percent. The opening ratio defines the ratio of the total width of the plurality of through-holes 14*b* with respect to the total width of the scraper blade 14 in the longitudinal direction thereof. Accordingly, when the scraper blade 14 is elastically deformed or bent in a predetermined amount to slide over the rotating conveyance member 8, the scraper blade 14 contacts the conveyance member 8 with desired pressure therebetween.

As shown in FIGS. 11 and 13, the lids 141 and 192 cover the through-holes 14*b* of the scraper blade 14. Accordingly, the lids 141 and 192 prevent the waste toner 15 contained in the waste toner container 10 from entering the through-holes 14*b* of the scraper blade 14.

The Young's modulus and/or the thickness of the lids 141 and 192 are smaller than those of the scraper blade 14. Accordingly, elastic deformation of the lids 141 and 192 does not adversely affect pressure between the scraper blade 14 and the conveyance member 8.

The load required to bend the lids 141 and 192 for a predetermined amount is one tenth or smaller of the load required to bend the scraper blade 14 for the identical predetermined amount. Accordingly, elastic deformation of the lids 141 and 192 does not adversely affect pressure between the scraper blade 14 and the conveyance member 8.

As shown in FIGS. 2 and 3, the cleaner 9 includes the cleaning blade 7 serving as a cleaning member that scrapes residual toner not transferred onto a recording medium P and therefore remaining on the photoconductor 12 serving as an image carrier off the photoconductor 12; and the toner conveyer 30 that conveys the scraped toner as waste toner 15 to the waste toner container 10. Accordingly, the toner conveyer 30 conveys the waste toner 15 scraped off the photoconductor 12 by the cleaning blade 7 to the waste toner container 10 smoothly, preventing the scraped waste toner 15 from adhering to the photoconductor 12 again without being caught by the cleaning blade 7 and thus minimizing cleaning failure.

As shown in FIGS. 1 and 2, the image forming apparatus 100 that transfers a toner image formed on the photoconductor 12 onto a recording medium P includes the cleaner 9 that removes waste adherent, that is, the waste toner 15, adhered to the photoconductor 12 off the photoconductor 12. Accordingly, the image forming apparatus 100 minimizes cleaning failure and adhesion of the waste toner 15 to the charging roller 22 and the recording medium P, which result in formation of a faulty toner image on the recording medium P.

As shown in FIGS. 1 and 2, the photoconductor 12 and the cleaner 9 are united into the process cartridge 1 detachably attached to the image forming apparatus 100. Accordingly, the process cartridge 1 minimizes cleaning failure and adhesion of the waste toner 15 to the charging roller 22 and the recording medium P, which result in formation of a faulty toner image on the recording medium P.

Figure 14:
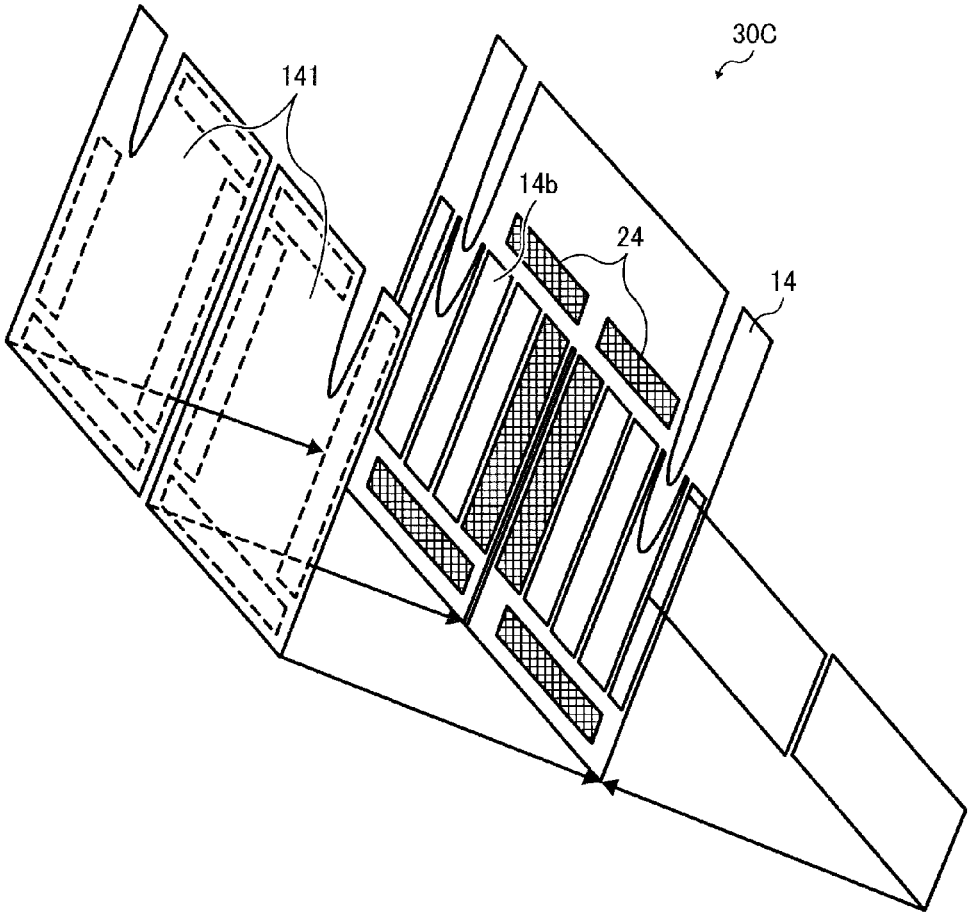
FIG. 14 is a partial perspective view of a comparative toner conveyor.
Figure 15A:
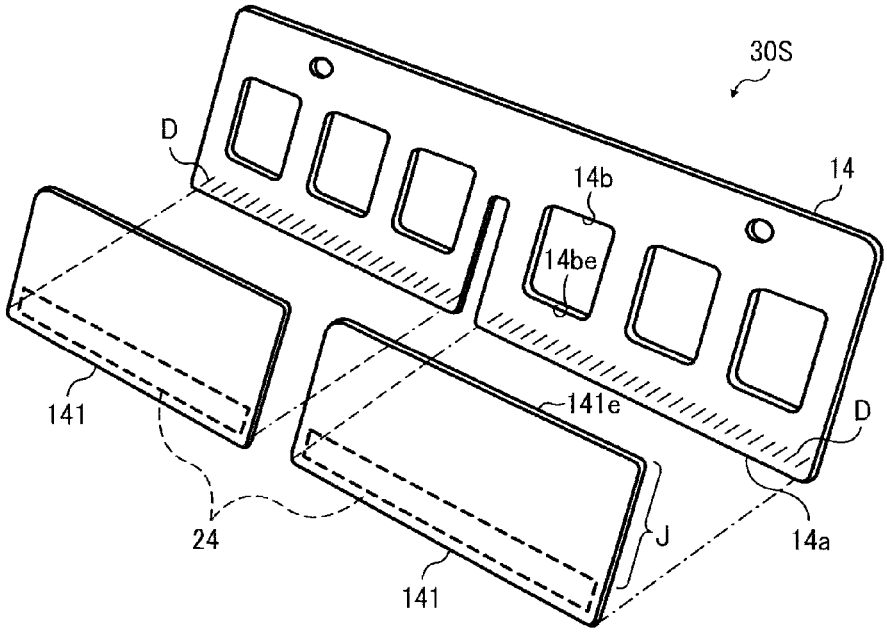
FIG. 15A is an exploded perspective view of a toner conveyor according to a second exemplary embodiment of the present invention.
Figure 15B:
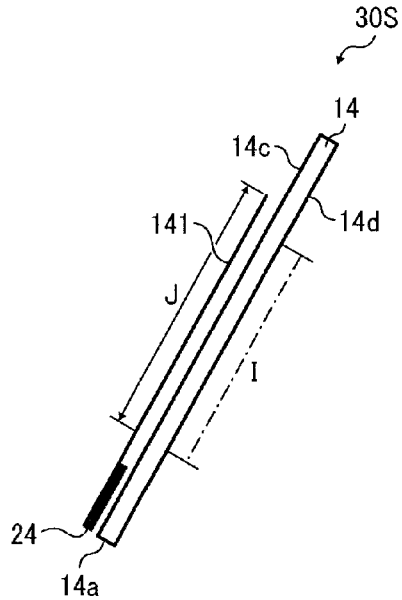
FIG. 15B is a side view of the toner conveyor shown in FIG. 15A.

With reference to FIGS. 14, 15A, and 15B, a description is provided of a configuration of a comparative toner conveyor 30C and a toner conveyor 30S according to a second exemplary embodiment.

FIG. 14 is a partial perspective view of the comparative toner conveyor 30C. As shown in FIG. 14, a plurality of through-holes 14*b* is produced through the scraper blade 14 made of metal to decrease the rigidity of the scraper blade 14. As the conveyance member 8 depicted in FIG. 2 rotates in the rotation direction R1, the scraper blade 14 elastically deforms and slides over the conveyance member 8, adjusting pressure between the scraper blade 14 and the conveyance member 8. The lid 141 is attached to the scraper blade 14 to cover the through-holes 14*b*, thus preventing the waste toner 15 contained in the waste toner container 10 from entering the through-holes 14*b*.

If the lid 141 has an increased rigidity, then even through the through-holes 14*b* are produced through the scraper blade 14, the rigid lid 141 obstructs elastic deformation of the scraper blade 14. To address this situation, the lid 141 is made of a material less rigid than metal, such as PET. A circumference of the lid 141 is adhered to the scraper blade 14 with an adhesive 24 such as double-faced tape so that the lid 141 deforms with the scraper blade 14. As the waste toner 15 accumulates inside the waste toner container 10, the waste toner 15 accumulates on the scraper blade 14. If the lid 141 is thin and damaged, the lid 141 may be broken by pressure from the waste toner 15 accumulated on the scraper blade 14, allowing the waste toner 15 contained in the waste toner container 10 to enter the through-holes 14*b*. To address this problem, the lid 141 is required to have an increased thickness that prevents breakage even if the lid 141 is damaged.

However, the lid 141 having a configuration shown in FIG. 14 is subject to plastic deformation (e.g., creep strain) after the lid 141 made of PET is stored at high temperatures indefinitedly. Accordingly, the scraper blade 14 also deforms in accordance with deformation of the lid 141, decreasing pressure between the scraper blade 14 and the conveyance member 8. Further, as shown in FIG. 9D, the contact position where the free end 14*a* of the scraper blade 14 contacts the conveyance member 8 moves toward the waste toner container 10.

To address these problems, the lid 141 is attached to the scraper blade 14 in a region of the scraper blade 14 extending from a lower edge of the through-holes 14*b* to the free end 14*a* of the scraper blade 14. The lid 141 is separatably contactable against the scraper blade 14 in an upper part of the lid 141.

A detailed description of a configuration of the lid 141 is given below with reference to FIGS. 15A and 15B.

FIG. 15A is an exploded perspective view of the scraper blade 14 and the lid 141 incorporated in the toner conveyor 30S. FIG. 15B is a side view of the scraper blade 14 and the lid 141 incorporated in the toner conveyor 30S. The through-holes 14*b* cover a region I indicated by the dotted line in FIG. 15B. The scraper blade 14 is made of metal and produced with multiple through-holes 14*b*. The through-holes 14*b* are covered with the lid 141 made of an elastic film such as a PET sheet. As shown in FIG. 15A, the lid 141 is dimensioned to cover the through-holes 14*b* produced through the scraper blade 14. The adhesive 24 such as double-faced tape is adhered to the lid 141 in a region thereof disposed opposite an adhesion region D situated between the free end 14*a* and a lower edge 14*be* of the through-holes 14*b* in the short direction of the scraper blade 14. As shown in FIG. 15B, with the adhesive 24, the lid 141 is adhered and fixed to the adhesion region D on the toner carrying face 14*c* of the scraper blade 14 that is in contact with the waste toner 15 contained in the waste toner container 10 and is opposite the opposed face 14*d* facing the conveyance member 8 depicted in FIG. 3. Accordingly, a separation region J of the lid 141 extending from an upper edge 141*e* of the lid 141 to a position disposed opposite the lower edge 14*be* of the through-holes 14*b* in the short direction of the scraper blade 14 is not adhered to the scraper blade 14 and thereby is separatable from the scraper blade 14.

With reference to FIGS. 16A to 16F, a description is provided of operation of the toner conveyor 30S incorporating the scraper blade 14 shown in FIGS. 15A and 15B.

Figure 16A:
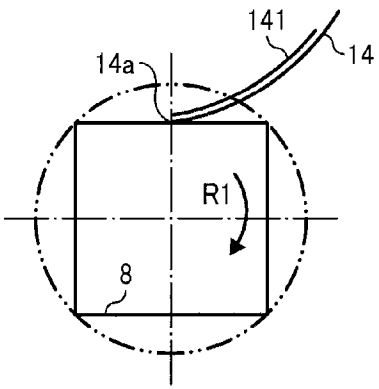
FIG. 16A is a vertical sectional view of the scraper blade and the conveyance member incorporated in the toner conveyor shown in FIG. 15A in a state in which the scraper blade contacts the center on the outer surface of the conveyance member.
Figure 16B:
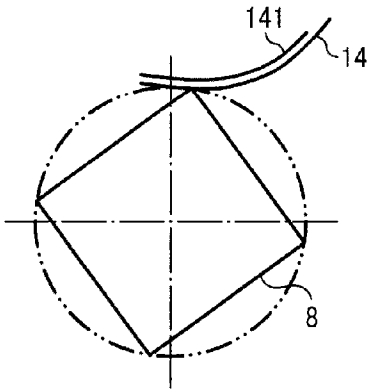
FIG. 16B is a vertical sectional view of the scraper blade and the conveyance member incorporated in the toner conveyor shown in FIG. 15A in a state in which the scraper blade is bent by the conveyance member substantially.

As shown in FIG. 16A, since the lid 141 is made of an elastic film less rigid than metal, the lid 141 is deformed readily as the scraper blade 14 is elastically deformed in an early stage of operation, bringing the scraper blade 14 into contact with the conveyance member 8 with predetermined pressure therebetween.

Figure 16C:
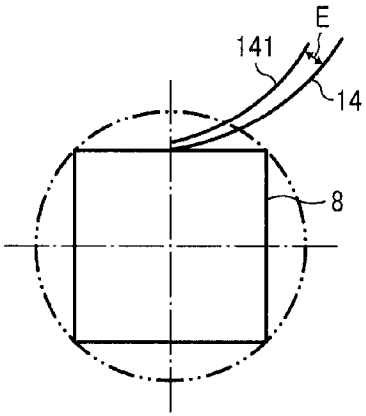
FIG. 16C is a vertical sectional view of the scraper blade and the conveyance member incorporated in the toner conveyor shown in FIG. 15A in a state in which the lid is isolated from the scraper blade.

The lid 141 is adhered to the scraper blade 14 in the adhesion region D on the scraper blade 14 disposed between the free end 14*a* and the lower edge 14*be* of the through-holes 14*b*. That is, the lid 141 is not adhered to the scraper blade 14 in a region other than the adhesion region D. Since the lid 141 is an elastic film made of a viscoelastic polymeric material, when the scraper blade 14 is left at high temperature in a state shown in FIG. 16B in which the scraper blade 14 slides over the corner of the conveyance member 8 and therefore the lid 141 is bent by plastic deformation or creep strain, the metal scraper blade 14 separates from the bent lid 141 with an interval E therebetween as shown in FIG. 16C, recovering its initial shape without being deformed in accordance with plastic deformation of the lid 141. Accordingly, the scraper blade 14 does not come into contact with the conveyance member 8 with decreased pressure therebetween. Moreover, the contact position where the free end 14*a* of the scraper blade 14 contacts the conveyance member 8 does not move toward the waste toner container 10 as shown in FIG. 9D.

Figure 16D:
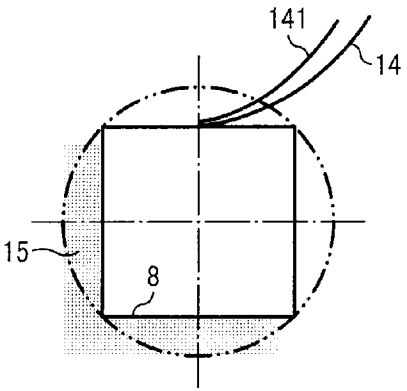
FIG. 16D is a vertical sectional view of the scraper blade and the conveyance member shown in FIG. 16C illustrating waste toner accumulating in the waste toner container.
Figure 16E:
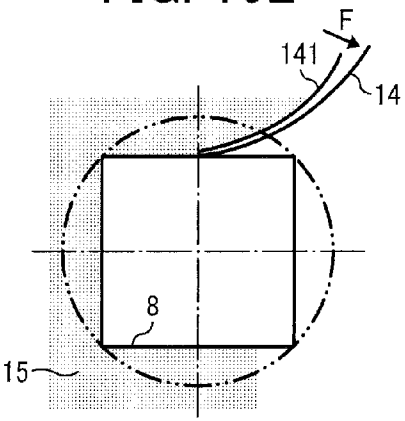
FIG. 16E is a vertical sectional view of the scraper blade and the conveyance member shown in FIG. 16D illustrating waste toner accumulating on the lid attached to the scraper blade.
Figure 16F:
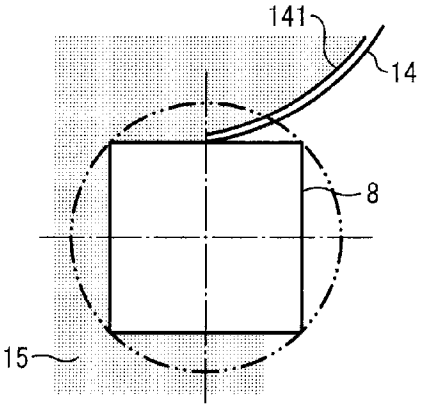
FIG. 16F is a vertical sectional view of the scraper blade and the conveyance member shown in FIG. 16E illustrating waste toner pressing the lid against the scraper blade.

As shown in FIGS. 16D to 16F, as the waste toner 15 is accumulated inside the waste toner container 10 and beyond the scraper blade 14, the waste toner 15 is accumulated on the lid 141 as shown in FIG. 16E.

As shown in FIG. 15B, the lid 141 is attached to the toner carrying face 14*c* of the scraper blade 14 that is in contact with the waste toner 15 contained in the waste toner container 10 and opposite the opposed face 14*d* of the scraper blade 14 disposed opposite the conveyance member 8. The lid 141 is adhered to the scraper blade 14 at a lower part thereof in the vertical direction. Accordingly, as shown in FIG. 16E, the waste toner 15 accumulates on the lid 141 from a lower part thereof adhered to the adhesion region D of the scraper blade 14 to an upper part thereof, that is, the separation region J of the lid 141, in the vertical direction. As the waste toner 15 accumulates on the lid 141, the lid 141 is moved toward the scraper blade 14 by the weight of the waste toner 15 accumulated on the lid 141 and brought into contact with the scraper blade 14. As shown in FIG. 16F, as the waste toner 15 further accumulates on the entire surface of the lid 141 disposed opposite the waste toner 15 contained in the waste toner container 10, the lid 141 comes into contact with the scraper blade 14 throughout the entire surface of the lid 141 disposed opposite the scraper blade 14. Accordingly, even if the lid 141 is permanently bent and therefore isolated from the scraper blade 14 as shown in FIG. 16C, as the waste toner 15 accumulated on the lid 141 presses the lid 141 against the scraper blade 14, the waste toner 15 does not move into a gap between the lid 141 and the scraper blade 14 and enter the through-holes 14*b* of the scraper blade 14. Consequently, even if the lid 141 is partially adhered to the scraper blade 14, that is, on the adhesion region D of the scraper blade 14 only, the lid 141 covers the through-holes 14*b* of the scraper blade 14.

Figure 17A:
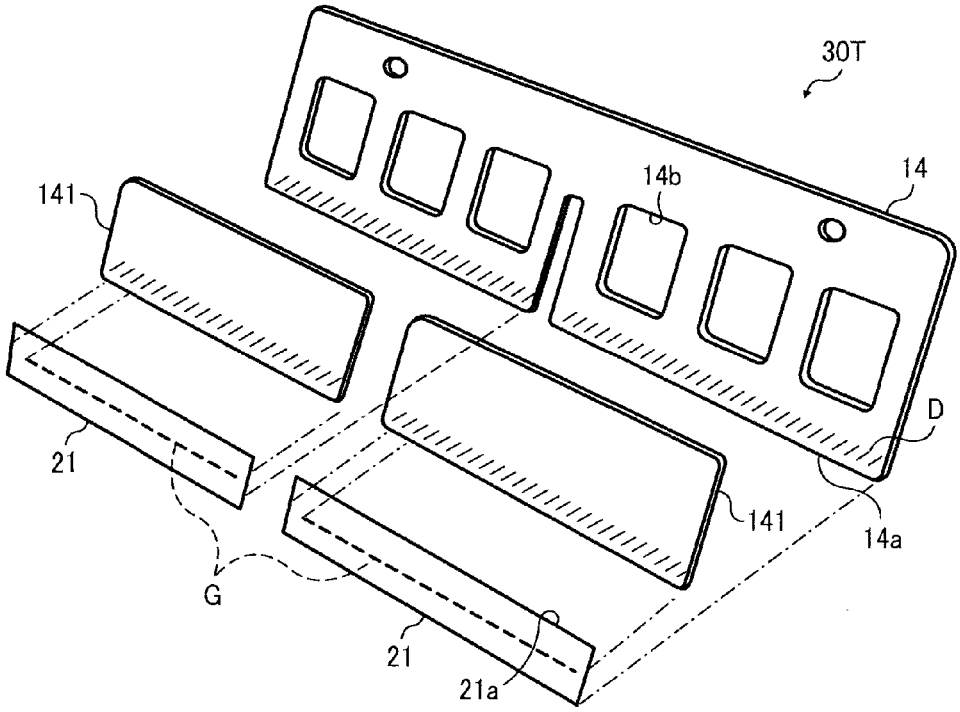
FIG. 17A is a partial exploded perspective view of a toner conveyor as a first variation of the toner conveyor shown in FIG. 15A.
Figure 17B:
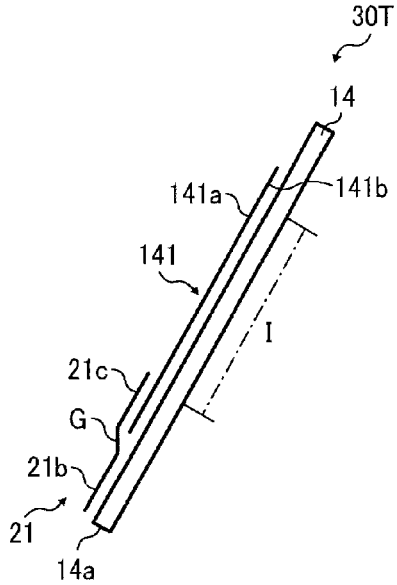
FIG. 17B is a side view of the toner conveyor shown in FIG. 17A.
Figure 18:
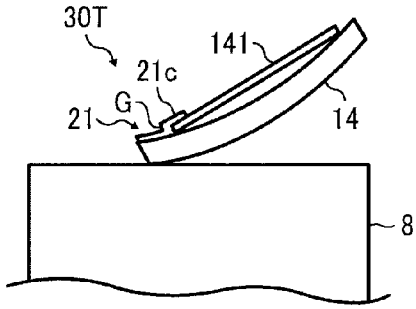
FIG. 18 is a side view of the scraper blade and the conveyance member incorporated in the toner conveyor shown in FIG. 17B.

With reference to FIGS. 17A, 17B, and 18, a description is provided of a configuration of a toner conveyor 30T as a first variation of the toner conveyor 30S depicted in FIG. 15A.

FIG. 17A is a partial exploded perspective view of the toner conveyor 30T. FIG. 17B is a side view of the toner conveyor 30T. As described above, the lid 141 has a predetermined thickness that makes the lid 141 endurable against pressure from the waste toner 15. For example, the thickness of the lid 141 made of PET is about 0.1 mm. As shown in FIG. 15B, the lid 141 is adhered to the scraper blade 14 directly. Accordingly, as shown in FIG. 16F, as the waste toner 15 accumulated on the lid 141 brings the bent lid 141 into contact with the scraper blade 14, a force retaining the bent lid 141 exerts a force that separates the lid 141 from the scraper blade 14 at a position where the lid 141 is adhered to the scraper blade 14. Consequently, the adhesion region D on the scraper blade 14 receives from the lid 141 a force that separates the scraper blade 14 from the conveyance member 8. For example, as shown in FIGS. 16A to 16F, with the configuration in which the lid 141 is adhered to the scraper blade 14 directly, the scraper blade 14 is influenced by plastic deformation or creep strain of the lid 141, thus decreasing pressure between the scraper blade 14 and the conveyance member 8.

To address this circumstance, as shown in FIG. 17B, an attachment 21, that is, a soft sheet or film that is softer than the lid 141, is attached to the scraper blade 14. The lid 141 is partially sandwiched between the scraper blade 14 and the attachment 21 in such a manner that the lid 141 is hinged with respect to the scraper blade 14 about a predetermined axis portion G of the attachment 21.

For example, the attachment 21 is made of PET or polyester and has a thickness of about 50 micrometers. As shown in FIG. 17A, an opposed face 21*a* of the attachment 21 facing the lid 141 is applied with double-faced tape or an adhesive. As shown in FIG. 17B, a lower portion 21*b* of the attachment 21 is attached to the adhesion region D of the scraper blade 14 contiguous to the free end 14*a* of the scraper blade 14. An upper portion 21*c* of the attachment 21 is attached to a toner carrying face 141*a* of the lid 141 opposite an opposed face 141*b* of the lid 141 facing the scraper blade 14. Thus, the lid 141 is hingedly attached to the scraper blade 14. Specifically, the axis portion G is interposed between the upper portion 21*c* and the lower portion 21*b* of the attachment 21. The lid 141 is hinged about the axis portion G of the attachment 21.

With reference to FIG. 18, a description is provided of a configuration of the scraper blade 14 shown in FIGS. 17A and 17B brought into contact with the conveyance member 8.

FIG. 18 is a side view of the scraper blade 14 and the conveyance member 8 incorporated in the toner conveyor 30T. When no waste toner 15 is contained in the waste toner container 10 in a brand new condition, for example, even if the scraper blade 14 is bent, the lid 141 is substantially straight without being bent. The lid 141 is indirectly adhered to the scraper blade 14 through the attachment 21 that is softer than the lid 141. Accordingly, as the scraper blade 14 is bent, the attachment 21 attached to the scraper blade 14 is subject to elastic deformation in accordance with deformation of the scraper blade 14 and therefore presses the lid 141 against the scraper blade 14. However, since a shape retention force of the lid 141 that retains its straight shape is greater than pressure exerted to the lid 141 by the attachment 21, the upper portion 21*c* of the attachment 21 attached to the lid 141 rotates about the axis portion G by the shape retention force of the lid 141 in a direction in which the upper portion 21*c* of the attachment 21 separates from the scraper blade 14. Consequently, even if the scraper blade 14 is bent, the lid 141 is barely bent, retaining its substantially straight shape. Even if the scraper blade 14 is stored indefinitely in a state in which the scraper blade 14 is bent as shown in FIG. 9B, the lid 141 retaining its substantially straight shape minimizes bending of the lid 141 by plastic deformation or creep strain.

If the scraper blade 14 is stored indefinitely in a state in which the scraper blade 14 is bent as shown in FIG. 9B, the attachment 21 is subject to plastic deformation or creep strain. However, since the attachment 21 is thinner and softer than the lid 141, the shape retention force of the attachment 21 is smaller than that of the lid 141. Accordingly, even if the attachment 21 is plastically deformed, it barely deforms the scraper blade 14. Consequently, the configuration shown in FIG. 17B in which the attachment 21 hingedly supports the lid 141 relative to the scraper blade 14 minimizes decrease in pressure with which the scraper blade 14 contacts the conveyance member 8 compared to the configuration shown in FIG. 15B in which the lid 141 is directly attached to the scraper blade 14.

Figure 19A:
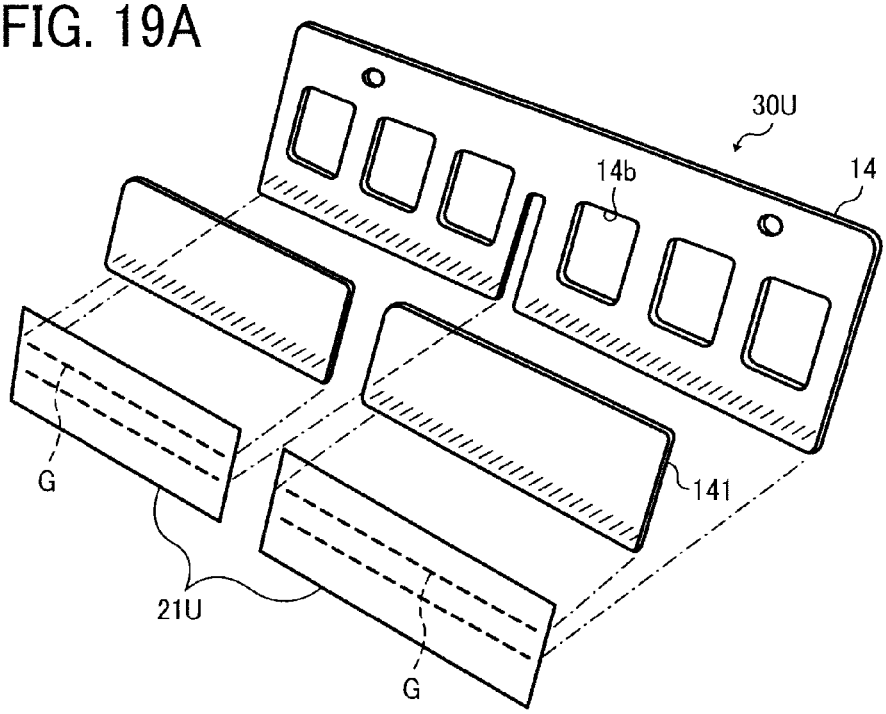
FIG. 19A is a partial exploded perspective view of a toner conveyor as a second variation of the toner conveyor shown in FIG. 15A.
Figure 19B:
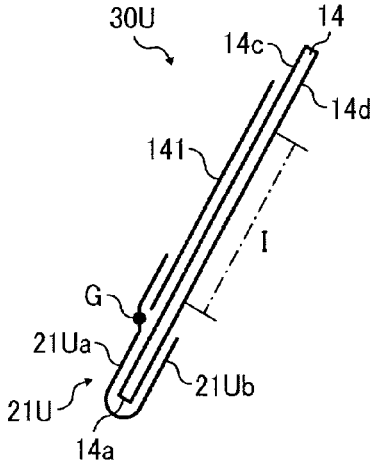
FIG. 19B is a side view of the toner conveyor shown in FIG. 19A.

With reference to FIGS. 19A and 19B, a description is provided of a configuration of a toner conveyor 30U as a second variation of the toner conveyor 30S shown in FIG. 15B.

FIG. 19A is a partial exploded perspective view of the toner conveyor 30U. FIG. 19B is a side view of the toner conveyor 30U. The scraper blade 14 is made of metal having a hardness greater than that of resin. The conveyance member 8 depicted in FIG. 3 is made of resin. Accordingly, as the scraper blade 14 slides over the conveyance member 8, the free end 14*a* of the metal scraper blade 14 may shave the conveyance member 8. To address this problem, the toner conveyor 30U includes an attachment 21U made of a material having a hardness smaller than that of metal and covering the free end 14*a* of the scraper blade 14.

For example, an opposed portion 21Ub of the attachment 21U facing the conveyance member 8 is attached to the opposed face 14*d* of the scraper blade 14 facing the conveyance member 8. The attachment 21U is folded back at the free end 14*a* of the scraper blade 14 to cover the free end 14*a*. Conversely, a toner carrying portion 21Ua of the attachment 21U facing the waste toner 15 contained in the waste toner container 10 is attached to the toner carrying face 14*c* of the scraper blade 14 opposite the opposed face 14*d* of the scraper blade 14.

Figure 20A:
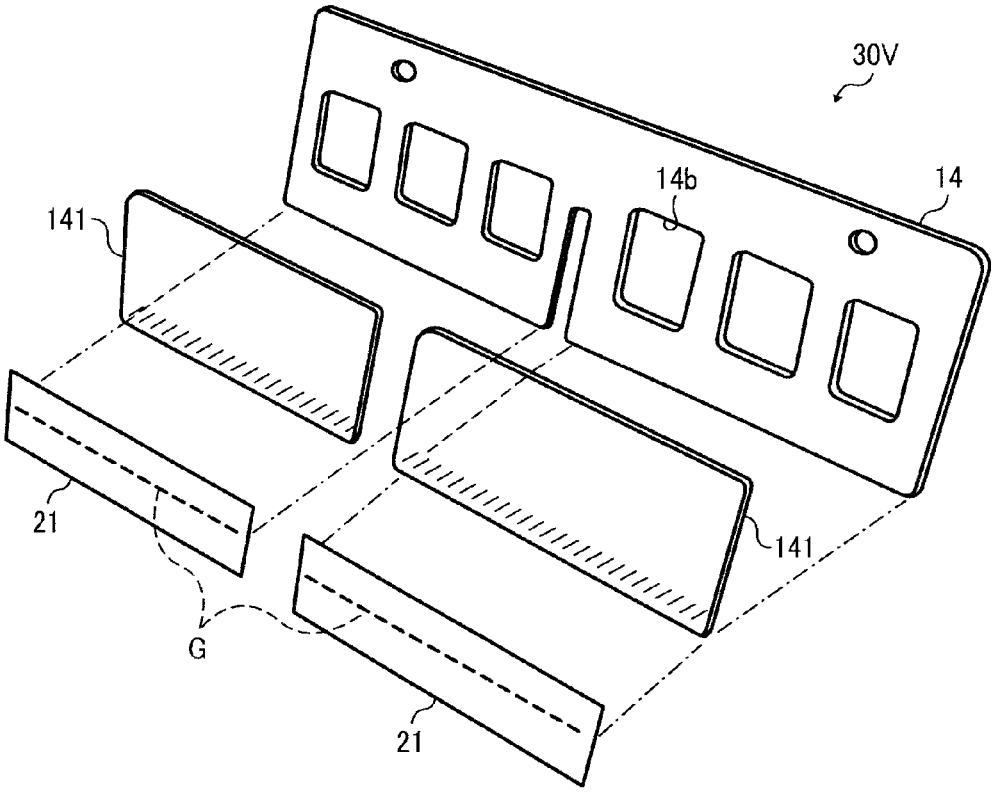
FIG. 20A is a partial exploded perspective view of a toner conveyor as another second variation of the toner conveyor shown in FIG. 15A.
Figure 20B:
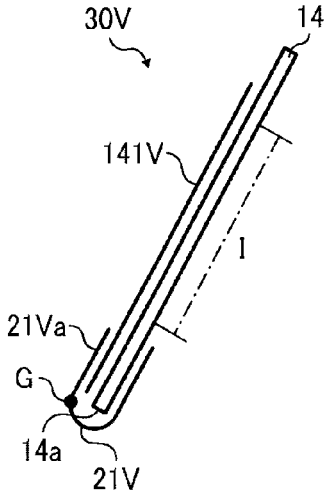
FIG. 20B is a side view of the toner conveyor shown in FIG. 20A.

With reference to FIGS. 20A and 20B, a description is provided of a configuration of a toner conveyor 30V as a variation of the toner conveyor 30U shown in FIG. 19B.

FIG. 20A is a partial exploded perspective view of the toner conveyor 30V. FIG. 20B is a side view of the toner conveyor 30V. As shown in FIG. 20B, the toner conveyor 30V includes a lid 141V extending to the free end 14*a* of the scraper blade 14 and an attachment 21V including a toner carrying portion 21Va attached to the lid 141V entirely. Since the lid 141V extends to the free end 14*a* of the scraper blade 14, the axis portion G of the attachment 21V about which the lid 141V is hinged with respect to the scraper blade 14 is situated below the axis portion G of the attachment 21U depicted in FIG. 19B and in proximity to the free end 14*a* of the scraper blade 14. Since both the toner conveyors 30U and 30V achieve the identical advantages of the attachments 21U and 21V, the configuration shown in FIG. 19B or 20B may be employed for ease in assembly.

As shown in FIGS. 19B and 20B, the attachment 21U or 21V made of a flexible film covers the free end 14*a* of the scraper blade 14. Hence, the conveyance member 8 is contacted by the flexible attachment 21U or 21V and therefore is not shaved by the scraper blade 14. The attachments 21U and 21V also attain the above advantages of the attachment 21 depicted in FIG. 17B.

Figure 21A:
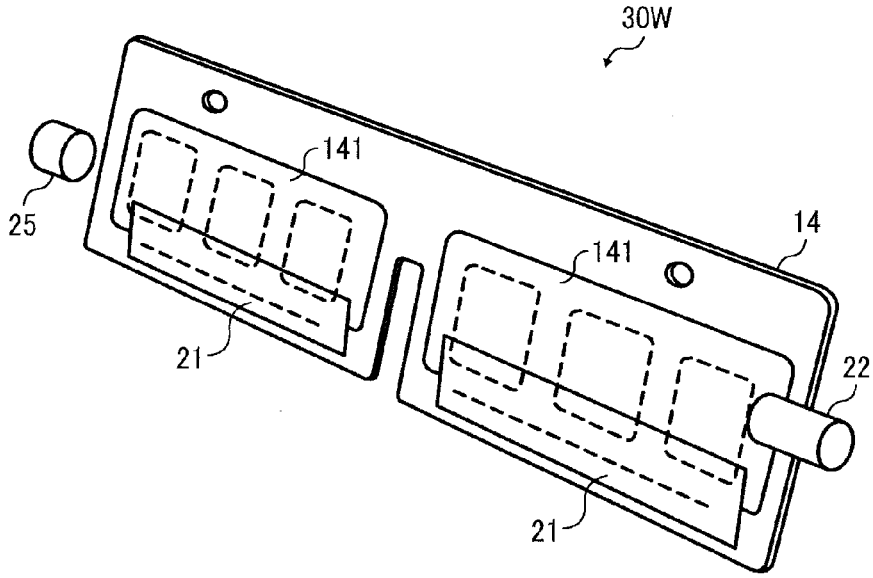
FIG. 21A is a partial exploded perspective view of a toner conveyor as a third variation of the toner conveyor shown in FIG. 15A.
Figure 21B:
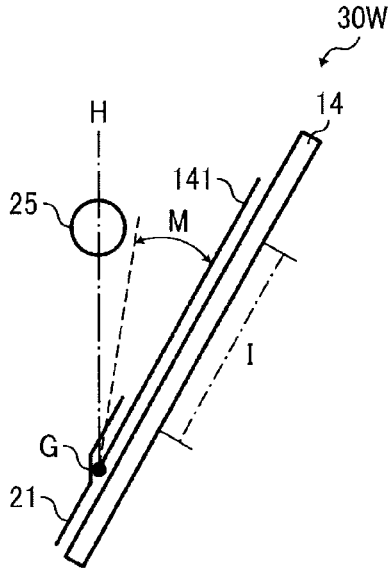
FIG. 21B is a side view of the toner conveyor shown in FIG. 21A.

With reference to FIGS. 21A and 21B, a description is provided of a configuration of a toner conveyor 30W as a third variation of the toner conveyor 30S shown in FIG. 15B.

FIG. 21A is a partial exploded perspective view of the toner conveyor 30W. FIG. 21B is a side view of the toner conveyor 30W. In the toner conveyors 30T, 30U, and 30V depicted in FIGS. 17B, 19B, and 20B, respectively, the lids 141 and 141V are rotatable about the axis portion G of the attachments 21, 21U, and 21V that attach the lids 141 and 141V to the scraper blade 14. Accordingly, if the image forming apparatus 100 depicted in FIG. 1 is rotated or tilted in a direction counter to the rotation direction R1 of the conveyance member 8 during transportation, for example, the lids 141 and 141V may rotate about the axis portion G by about 180 degrees and may be reversed. If the conveyance member 8 is driven and rotated in the rotation direction R1 while the lid 141 or 141V is reversed, the waste toner 15 contained in the waste toner container 10 may enter the through-holes 14*b* of the scraper blade 14.

To address this problem, as shown in FIG. 21A, the toner conveyor 30W includes a detent 25 serving as a convex regulator that regulates rotation of the lid 141 about the axis portion G of the attachment 21 within a predetermined amount toward the waste toner container 10. As shown in FIG. 21B, the detent 25 is situated at a position closer to the scraper blade 14 than a hypothetical perpendicular H passing through the axis portion G of the attachment 21. That is, the lid 141 is movable or hinged in a movable range M until the lid 141 comes into contact with the detent 25. Accordingly, even if the image forming apparatus 100 depicted in FIG. 1 is rotated or tilted in the direction counter to the rotation direction R1 of the conveyance member 8 and the lid 141 is nearly reversed, the lid 141 comes into contact with and is halted by the detent 25. Thus, the detent 25 regulates rotation of the lid 141 toward the waste toner container 10. Accordingly, the lid 141 is not reversed. As shown in FIG. 21B, the position where the lid 141 comes into contact with the detent 25 is on the right of the hypothetical perpendicular H passing through the axis portion G of the attachment 21, that is, between the hypothetical perpendicular H and the scraper blade 14. Accordingly, as the lid 141 comes into contact with the detent 25, while the image forming apparatus 100 is in operation, the lid 141 moves or falls to the scraper blade 14 by its weight, thus blocking the through-holes 14*b* of the scraper blade 14.

Figure 22A:
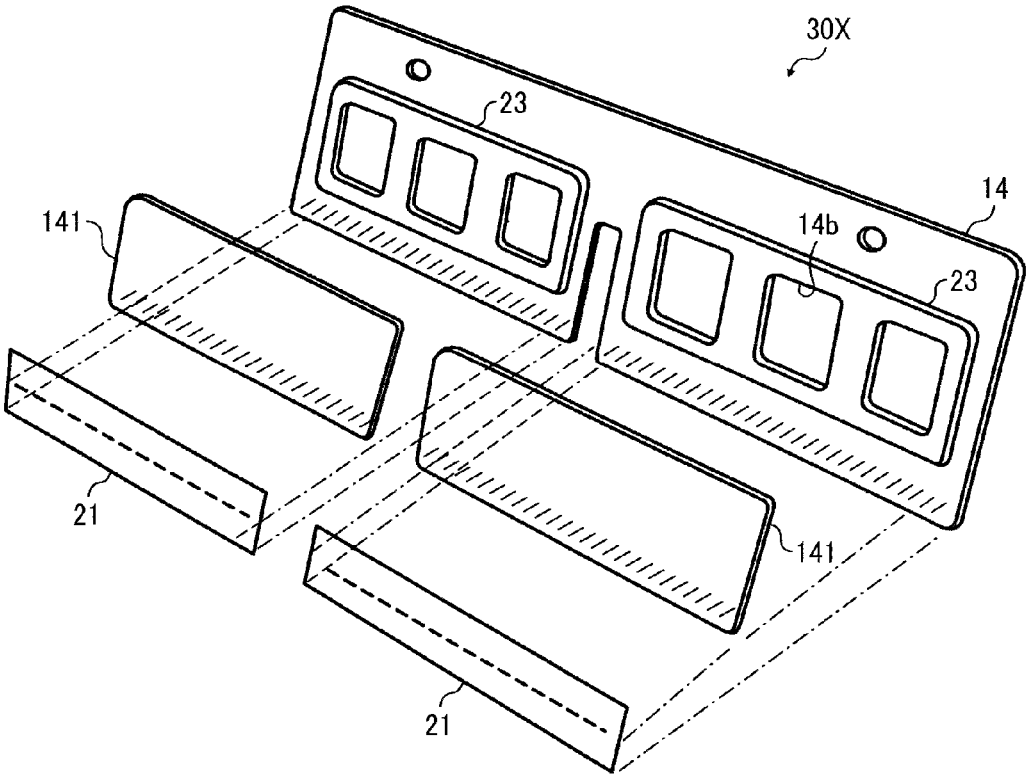
FIG. 22A is a partial exploded perspective view of a toner conveyor as a fourth variation of the toner conveyor shown in FIG. 15A.
Figure 22B:
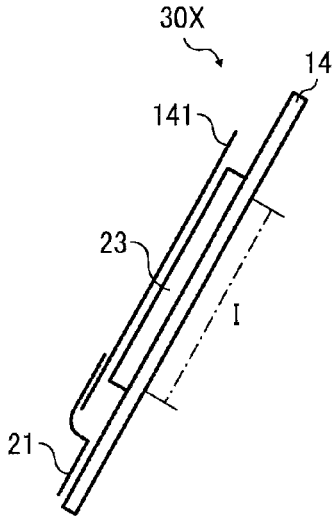
FIG. 22B is a side view of the toner conveyor shown in FIG. 22A.

With reference to FIGS. 22A and 22B, a description is provided of a configuration of a toner conveyor 30X as a fourth variation of the toner conveyor 30S shown in FIG. 15B.

FIG. 22A is a partial exploded perspective view of the toner conveyor 30X. FIG. 22B is a side view of the toner conveyor 30X. As shown in FIG. 22A, a seal 23, that is, an elastic member made of sponge, is interposed between the scraper blade 14 and the lid 141. The seal 23 surrounds each through-hole 14*b* of the scraper blade 14. As described above, the waste toner 15 contained in the waste toner container 10 presses the lid 141 against the bent scraper blade 14, thus bringing the lid 141 into contact with the scraper blade 14. The seal 23 enhances intimate contact of the lid 141 with the bent scraper blade 14 by pressure from the waste toner 15. Thus, the seal 23 prevents the waste toner 15 from entering the through-holes 14*b* of the scraper blade 14 precisely.

With reference to FIGS. 15A to 22B, a description is provided of advantages of the toner conveyors 30S, 30T, 30U, 30V, 30W, and 30X according to the second exemplary embodiment described above.

The toner conveyor (e.g., the toner conveyors 30S, 30T, 30U, 30V, 30W, and 30X) includes the noncircular conveyance member 8 (depicted in FIG. 3) in cross-section rotatable in the predetermined rotation direction R1 to convey the waste toner 15 to the waste toner container 10; and the plate-shaped metal scraper or the metal plate (e.g., the scraper blade 14) in contact with the conveyance member 8 with predetermined pressure therebetween to scrape the waste toner 15 off the conveyance member 8. The scraper is produced with the through-holes 14*b* at a position spaced apart from the free end 14*a*, serving as a contact end, of the scraper. The lid (e.g., the lids 141 and 141V) is attached to the toner carrying face 14*c* of the scraper that contacts the waste toner 15 contained in the waste toner container 10 to cover the through-holes 14*b*. At least a part of the lid that covers the through-holes 14*b*, that is, the separation region J extending from the upper edge 141*e* of the lid to a position of the lid disposed opposite the lower edge 14*be* of the through-holes 14*b* in the short direction of the scraper, is separatable from the scraper. Accordingly, even if the lid is bent or plastically deformed by creep strain, the scraper is bent by its elastic deformation, not in accordance with bending of the lid, thus minimizing decrease in pressure between the scraper and the conveyance member 8 and scraping the waste toner 15 off the conveyance member 8 precisely. Consequently, the conveyance member 8 conveys a proper amount of the waste toner 15 precisely.

Even if an interval is created between the lid and the through-holes 14*b* of the scraper, as the waste toner 15 accumulates inside the waste toner container 10 to a height of the through-holes 14*b* of the scraper, the waste toner 15 in contact with the lid presses the lid against the scraper, adhering the lid to the scraper. Accordingly, the lid blocks the through-holes 14*b* of the scraper, preventing the waste toner 15 from entering the through-holes 14*b*.

The lid is made of an elastic film. That is, the rigidity of the elastic lid is smaller than that of the metal scraper. Accordingly, as the waste toner 15 contained in the waste toner container 10 presses the lid against the scraper, the lid is elastically deformed in accordance with bending of the scraper. Thus, the lid is adhered to the scraper.

As shown in FIG. 15A, the lid is adhered to the adhesion region D on the toner carrying face 14*c* of the scraper provided between the free end 14*a* of the scraper and the lower edge 14*be* of the through-holes 14*b* in the short direction of the scraper. Accordingly, the lid is mounted on the scraper with a simple structure.

As shown in FIGS. 17B, 19B, and 20B, the lid is attached to the scraper with the attachment (e.g., the attachments 21, 21U, and 21V) made of a film thinner and softer than the lid. The lid is rotatable with respect to the scraper about the axis portion G of the attachment. Accordingly, the attachment minimizes elastic deformation of the lid in accordance with bending of the scraper, thus preventing deformation of the lid by creep strain.

As shown in FIGS. 19B and 20B, the attachment covers the free end 14*a* of the scraper. Accordingly, the free end 14*a* of the scraper slides over the conveyance member 8 via the attachment, minimizing wear of the conveyance member 8. Additionally, the attachment attaches the lid to the scraper and at the same time covers the free end 14*a* of the scraper, decreasing the number of parts and the number of assembly processes compared to a configuration in which a cover that covers the free end 14*a* of the scraper is separately provided from an attachment that attaches the lid to the scraper.

As shown in FIGS. 21A and 21B, the regulator (e.g., the detent 25) regulates rotation of the lid, thus preventing the lid from rotating farther than a predetermined amount. Accordingly, the regulator prevents the lid from being reversed.

As shown in FIGS. 22A and 22B, the elastic member (e.g., the seal 23) softer than the lid is interposed between the lid and the scraper. Accordingly, as the waste toner 15 contained in the waste toner container 10 presses the lid against the scraper, the elastic member facilitates adhesion of the lid to the scraper. Consequently, the elastic member prevents the waste toner 15 from entering the through-holes 14*b* of the scraper precisely.

As shown in FIG. 3, the cleaner 9 includes the cleaning member (e.g., the cleaning blade 7) that scrapes the waste toner 15 not transferred onto a recording medium P and therefore remaining on the image carrier (e.g., the photoconductor 12) off the image carrier; and the toner conveyor (e.g., the toner conveyor 30) that conveys the waste toner 15 scraped by the cleaning member to the waste toner container 10. Accordingly, the toner conveyor conveys the waste toner 15 scraped by the cleaning member to the waste toner container 10 precisely, preventing the waste toner 15 from returning and adhering to the image carrier and thereby preventing cleaning failure of the image carrier.

As shown in FIGS. 1 and 2, the image forming apparatus 100 for transferring a toner image formed on the image carrier onto a recording medium P employs the cleaner 9 that removes a waste adherent (e.g., the waste toner 15) from the image carrier. Accordingly, the image forming apparatus 100 minimizes cleaning failure of the image carrier and prevents adhesion of the waste toner 15 to the charger (e.g., the charging roller 22) and the recording medium P, thus minimizing formation of a faulty toner image on the recording medium P.

As shown in FIG. 2, the cleaner 9 and the image carrier are united into the process cartridge 1 detachably attached to the image forming apparatus 100. Accordingly, the process cartridge 1 minimizes cleaning failure and adhesion of the waste toner 15 to the charger and the recording medium P, which result in formation of a faulty toner image on the recording medium P.

As shown in FIG. 11, the contact member 142 less rigid than the scraper contacts the conveyance member 8, preventing the free end 14*a* of the scraper from shaving the conveyance member 8. Accordingly, the contact member 142 extends the life of the conveyance member 8 compared to a configuration in which the free end 14*a* of the metal scraper directly contacts the conveyance member 8.

As shown in FIG. 15A, the through-holes 14*b* produced through the scraper decrease the rigidity of the metal scraper. As the scraper elastically deforms and slides over the outer circumferential surface of the conveyance member 8, the scraper comes into contact with the conveyance member 8 with predetermined pressure therebetween, minimizing increase in torque of a driver that drives and rotates the conveyance member 8 and noise that may arise as the scraper slides over the conveyance member 8 with increased pressure therebetween. At least the separation region J extending from the upper edge 141*e* of the lid to the position disposed opposite the lower edge 14*be* of the through-holes 14*b* of the scraper in the short direction of the scraper is separatable from the scraper. Accordingly, unlike a configuration in which the entire lid is adhered to the scraper, even if the lid is deformed by creep strain, the scraper is not deformed in accordance with deformation of the lid. Consequently, even if the scraper and the lid are stored at high temperatures indefinitely, the scraper contacts the conveyance member 8 while maintaining the predetermined pressure therebetween, thus retaining collection performance of collecting the waste toner 15 from the conveyance member 8 into the waste toner container 10.

Further, even without making the lid thinner, the scraper contacts the conveyance member 8 while maintaining the predetermined pressure therebetween. That is, the lid has the increased thickness that prevents breakage of the lid due to pressure from the waste toner 15 contained in the waste toner container 10 even if the lid is somewhat damaged. Accordingly, the lid prevents the waste toner 15 contained in the waste toner container 10 from entering the through-holes 14*b* of the scraper.

When the lid is deformed by creep strain, an interval is created between the lid and the through-holes 14*b* of the scraper. To address this circumstance, the lid is attached to the toner carrying face 14*c* of the scraper that comes into contact with the waste toner 15 and receives pressure from the waste toner 15 accumulated in the waste toner container 10, thus blocking the through-holes 14*b* of the scraper and thereby preventing the waste toner 15 from entering the through-holes 14*b* of the scraper. For example, as the waste toner 15 accumulated in the waste toner container 10 reaches the scraper, the waste toner 15 comes into contact with the lid. Accordingly, the lid receives pressure from the waste toner 15.

However, since the lid is attached to the toner carrying face 14*c* of the scraper that receives pressure from the waste toner 15 accumulated in the waste toner container 10, the lid is pressed against the scraper by pressure from the waste toner 15, thus adhering to the scraper. Accordingly, the lid blocks the through-holes 14*b* of the scraper, preventing the waste toner 15 from entering the through-holes 14*b*.

According to the exemplary embodiments described above, the toner conveyors 30, 30S, 30T, 30U, 30V, 30W, and 30X convey the waste toner 15 scraped off the photoconductor 12 by the cleaning blade 7 to the waste toner container 10. Alternatively, the configuration of the toner conveyors 30, 30S, 30T, 30U, 30V, 30W, and 30X may be applicable to other toner conveyors, for example, a toner conveyor incorporated in an intermediate transferor cleaner installed in an image forming apparatus employing an intermediate transfer method in which a toner image is transferred onto a recording medium via an intermediate transferor.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A toner conveyor for conveying toner to a toner container, the toner conveyor comprising:

a noncircular conveyance member rotatable in a predetermined direction of rotation to convey the toner to the toner container;

a plate-shaped metal scraper slidably contacting the conveyance member with predetermined pressure therebetween to scrape the toner off the conveyance member, the scraper including:

a contact end contacting the conveyance member;

at least one through-hole spaced apart from the contact end; and a toner carrying face contacting the toner accumulated in the toner container; and a lid attached to the toner carrying face of the scraper to cover the at least one through-hole of the scraper and including a separation region extending from an upper edge thereof to at least a position disposed opposite a lower edge of the at least one through-hole in a short direction of the scraper, the separation region separatable from the scraper.

2. The toner conveyor according to claim 1, wherein the lid includes an elastic body.

3. The toner conveyor according to claim 1, wherein the lid is adhered to an adhesion region on the toner carrying face of the scraper provided between the contact end of the scraper and the lower edge of the at least one through-hole in the short direction of the scraper.

4. The toner conveyor according to claim 1, further comprising an attachment including a film thinner and softer than the lid, wherein the lid is attached to the scraper with the attachment in such a manner that the lid is rotatable with respect to the scraper about an axis portion of the attachment.

5. The toner conveyor according to claim 4, wherein the axis portion of the attachment is on the toner carrying face of the scraper and between the lid and the contact end of the scraper in the short direction of the scraper.

6. The toner conveyor according to claim 4, wherein the attachment covers the contact end of the scraper.

7. The toner conveyor according to claim 4, wherein the attachment is made of a material softer than metal.

8. The toner conveyor according to claim 4, further comprising a detent disposed opposite the lid to regulate rotation of the lid by contacting the lid.

9. The toner conveyor according to claim 8, wherein the detent is situated at a position closer to the scraper than a hypothetical perpendicular passing through the axis portion of the attachment.

10. The toner conveyor according to claim 1, further comprising an elastic member softer than the lid and interposed between the lid and the scraper.

11. The toner conveyor according to claim 1, further comprising a contact member attached to the scraper and projecting beyond the contact end of the scraper to contact the conveyance member, the contact member being made of a material softer than the material of the scraper.

12. The toner conveyor according to claim 11, wherein the contact member projects beyond the contact end of the scraper in an amount not greater than about 1 mm.

13. The toner conveyor according to claim 11, wherein the contact member includes a film.

14. The toner conveyor according to claim 1, wherein a ratio of a width of the at least one through-hole with respect to a width of the scraper in a longitudinal direction of the scraper is in a range of from about 50 percent to about 90 percent.

15. The toner conveyor according to claim 1, wherein at least one of the Young's modulus and a thickness of the lid is smaller than at least one of the Young's modulus and a thickness of the scraper.

16. The toner conveyor according to claim 1, wherein a load to bend the lid for a predetermined amount is not greater than one tenth of a load to bend the scraper for the identical predetermined amount.

17. The toner conveyor according to claim 1, wherein the lid covers the contact end of the scraper and includes an elastic film.

18. A process cartridge detachably attached to an image forming apparatus, the process cartridge comprising:

an image carrier to carry a toner image; and the toner conveyor according to claim 1 to receive toner from the image carrier.

19. An image forming apparatus comprising the process cartridge according to claim 18.

* * * * *